US011740061B2

(12) United States Patent
Peterson

(10) Patent No.: US 11,740,061 B2
(45) Date of Patent: Aug. 29, 2023

(54) PROJECTILES WITH INSERT-MOLDED POLYMER TIPS

(71) Applicant: Vista Outdoor Operations LLC, Anoka, MN (US)

(72) Inventor: Bryan P. Peterson, Isanti, MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

(21) Appl. No.: 17/867,009

(22) Filed: Jul. 18, 2022

(65) Prior Publication Data

US 2022/0373313 A1 Nov. 24, 2022

Related U.S. Application Data

(63) Continuation of application No. 17/065,656, filed on Oct. 8, 2020, now Pat. No. 11,391,551, which is a continuation of application No. 16/057,764, filed on Aug. 7, 2018, now Pat. No. 10,801,820, which is a continuation of application No. 15/294,171, filed on Oct. 14, 2016, now Pat. No. 10,041,773.

(60) Provisional application No. 62/241,256, filed on Oct. 14, 2015.

(51) Int. Cl.

| | |
|---|---|
| ***F42B 12/78*** | (2006.01) |
| ***F42B 12/74*** | (2006.01) |
| ***F42B 33/00*** | (2006.01) |
| ***F42B 30/02*** | (2006.01) |

(52) U.S. Cl.

CPC ..... *F42B 12/78* (2013.01); *F42B 12/74* (2013.01); *F42B 30/02* (2013.01); *F42B 33/00* (2013.01)

(58) Field of Classification Search

CPC ..... F42B 33/00; F42B 30/02; F42B 12/34; F42B 12/72; F42B 12/74; F42B 12/745

See application file for complete search history.

(56) References Cited

U.S. PATENT DOCUMENTS

| | | | |
|---|---|---|---|
| 375,158 | A | 12/1887 | Hill |
| 535,101 | A | 3/1895 | Godfrey et al. |
| 1,080,974 | A | 12/1913 | Johnson |
| 1,135,357 | A | 4/1915 | Clyne |
| 1,328,334 | A | 1/1920 | Newton |

(Continued)

FOREIGN PATENT DOCUMENTS

| | | |
|---|---|---|
| GB | 190622505 A | 5/1907 |
| WO | WO 01/18483 | 3/2001 |

*Primary Examiner* — J. Woodrow Eldred

(74) *Attorney, Agent, or Firm* — Reed Smith LLP; Matthew P. Frederick; Travis J. Sumpter

(57) ABSTRACT

Aspects of the disclosure are directed to manufacturing an insert-molded expanding projectile. Aspects of the disclosure include locating a portion of a projectile body within a converging tip mold, the projectile body including a metal jacket extending from a tail portion to a nose portion and surrounding an interior solid core. The metal jacket and nose portion may be tapered in a forward direction to an annular forward edge defining an opening to an undercut interior cavity. Melted polymer may be injected into the converging tip mold and allowed to cool thereby forming a polymer tip having a main portion forward of the opening and a tip retention portion filling the undercut interior cavity and having a shape corresponding to the undercut interior cavity to retain the polymer tip in place.

21 Claims, 19 Drawing Sheets

(56) References Cited

U.S. PATENT DOCUMENTS

| | | | | |
|---|---|---|---|---|
| 1,493,614 | A | 5/1924 | Dickerman | |
| 1,967,416 | A | 7/1934 | Leussler | |
| 2,696,130 | A | 12/1954 | Peters | |
| 2,928,348 | A | 3/1960 | Zisman et al. | |
| 3,881,421 | A | 5/1975 | Burczynski | |
| 4,044,685 | A | 8/1977 | Avcin | |
| 4,108,074 | A | 8/1978 | Billing, Jr. et al. | |
| 4,245,557 | A | 1/1981 | Knappworst et al. | |
| 4,655,140 | A | 4/1987 | Schirneker | |
| 4,685,397 | A | 8/1987 | Schirneker | |
| 5,127,332 | A | 7/1992 | Corzine et al. | |
| 5,259,320 | A | 11/1993 | Brooks | |
| 5,454,325 | A | 10/1995 | LeBlanc | |
| 6,070,532 | A | 6/2000 | Halverson | |
| 6,317,946 | B1 | 11/2001 | Beal | |
| 6,526,893 | B2 | 3/2003 | May et al. | |
| 6,546,875 | B2 | 4/2003 | Vaughn et al. | |
| 7,380,502 | B2 | 6/2008 | Emary | |
| 7,503,521 | B2 | 3/2009 | Maynard et al. | |
| 7,748,325 | B2 | 7/2010 | Marx | |
| 7,900,561 | B2 | 3/2011 | Marx | |
| 8,186,277 | B1 | 5/2012 | King | |
| 8,286,558 | B2 | 10/2012 | Marx | |
| 8,393,273 | B2 | 3/2013 | Weeks et al. | |
| 8,752,484 | B2 | 6/2014 | Burczynski | |
| D733,252 | S | 6/2015 | Burczynski et al. | |
| 9,366,512 | B2 | 6/2016 | Burczynski | |
| 9,494,397 | B2 | 11/2016 | Carlson et al. | |
| 10,041,773 | B2 * | 8/2018 | Peterson | F42B 12/74 |
| 10,801,820 | B2 * | 10/2020 | Peterson | F42B 30/02 |
| 11,391,551 | B2 * | 7/2022 | Peterson | F42B 12/78 |
| 2007/0289475 | A1 | 12/2007 | Kapeles | |
| 2010/0078844 | A1 | 4/2010 | Kapeles | |
| 2012/0180687 | A1 | 7/2012 | Padgett et al. | |
| 2013/0025490 | A1 | 1/2013 | Burczynski | |
| 2014/0311372 | A1 | 10/2014 | Burczynski | |
| 2014/0331885 | A1 | 11/2014 | Burczynski | |
| 2016/0169645 | A1 | 6/2016 | Emary et al. | |
| 2017/0115104 | A1 | 4/2017 | Peterson | |
| 2020/0256656 | A1 | 8/2020 | Thielen | |
| 2021/0180927 | A1 | 6/2021 | Agazim et al. | |
| 2021/0341275 | A1 | 11/2021 | Robbins et al. | |

* cited by examiner

STRAIGHTING AND CUTTING WIRE FROM COIL TO FORM A BILLET 372

DEFORMING THE BILLET 372 TO FORM A WORKPIECE 378

DEFORMING THE WORKPIECE 378 TO FORM A PROJECTILE BODY 300

INTRODUCING LIQUID MAT'L INTO THE INTERIOR CAVITY

INTRODUCING THERMOPLASTIC MAT'L INTO A CAVITY TO FORM A TIP 336

PROJECTILES WITH INSERT-MOLDED POLYMER TIPS

CROSS-REFERENCE TO RELATED APPLICATIONS

The present application is a continuation of U.S. patent application Ser. No. 17/065,656, filed Oct. 8, 2020, which is a continuation of U.S. patent application Ser. No. 16/057,764, filed Aug. 7, 2018, now U.S. Pat. No. 10,801,820, issued Oct. 13, 2020, which is a continuation of U.S. patent application Ser. No. 15/294,171, filed Oct. 14, 2016, now U.S. Pat. No. 10,041,773, issued Aug. 7, 2018, which claims the benefit of Provisional Patent Application No. 62/241,256, filed Oct. 14, 2015, which are hereby incorporated by reference in their entirety.

FIELD OF THE DISCLOSURE

The present disclosure relates to firearm projectiles, and more specifically, to cartridges and bullets having a polymer tip.

BACKGROUND

In the sport of hunting, responsible hunters go to great lengths to ensure a quick, clean and humane kill. Hunters seek to select the best rifle, cartridge, bullet and optics for the particular species being hunted and the specific conditions likely to be encountered (e.g., rough terrain and thick underbrush). Hunters also practice marksmanship so that a shot can be carefully placed even under challenging circumstances. If a bullet is poorly placed, the game animal may travel a long distance through rough terrain after having been shot. In these situations, there is a risk that the wounded game animal will not be recovered. Firearm projectiles may be designed as "hollow-points", having a central pit or generally hollowed out frontal cavity that causes the projectile to expand upon impact with a target. Expansion may decrease penetration and as a result, increase the amount of kinetic energy transfer from the projectile to the target for improved stopping power. However, the central pit or hollowed out design may result in diminished aerodynamic characteristics. For example, the hollowed out design may increase axial drag which can reduce overall projectile accuracy.

SUMMARY

Aspects of the invention are directed to an expanding projectile for firing from a gun, the projectile including a projectile body and an insert-molded polymer tip. In one or more embodiments, the projectile body includes a metal jacket extending from a tail portion to a nose portion and surrounding an interior solid core. The metal jacket is tapered along the nose portion to an annular forward edge where the jacket defines an opening to the interior solid core. In one or more embodiments, the projectile is manufactured via an insert-molding process where a forward portion of the projectile body is located at least partially within a converging tip mold configured to form the polymer tip. In some embodiments, a liquid elastomer is injected into the converging tip mold thereby partially filling an interior cavity in the projectile with an elastomer portion. A melted polymer may be subsequently injected into the converging tip mold, thereby filling a remainder of the interior cavity and the converging tip mold with the melted polymer. In some embodiments, the melted polymer solidifies to form the polymer tip. In various embodiments, the polymer tip and the elastomer portion have a different durometer, such that the elastomer portion is relatively softer than the solidified polymer tip.

The polymer may include a main portion forward of the opening and a tip retention portion filling the interior cavity and having a shape corresponding to the interior cavity to retain the polymer tip in place. In some embodiments, the projectile includes a more steeply tapered forward portion that defines a forward facing annular ridge. The tip retention portion may include an exterior portion which encloses the forward portion of the projectile and fills the forward facing annular ridge to retain the polymer tip in place.

A feature and advantage of one or more embodiments is a projectile that addresses environmental concerns regarding lead by providing a projectile that is free of lead.

A feature and advantage of one or more embodiments is a projectile that folds along localized area of weakness to assume a deformed shape.

A feature and advantage of one or more embodiments is a projectile that forms an entrance wound when entering a body (such as the body of a game animal or a block of ballistic gel) and forms an exit wound that is larger than the entrance wound upon exiting the body. The relatively large exit wound may cause greater blood loss leading to a faster kill. The increased blood loss may also create a blood trail useful for tracking a wounded animal.

A feature and advantage of one or more embodiments is a projectile that deforms to an expanded or mushroomed shape while passing through a body (such as the body of a game animal or a block of ballistic gel). In one or more embodiments, the expanded or mushroomed shape has an overall lateral width and a surface area that is greater than the overall lateral width and the surface are of the undeformed projectile.

A feature and advantage of one or more embodiments is a projectile that forms multiple pedals while passing through a body (such as the body of a game animal or a block of ballistic gel). In one or more embodiments, the pedals provide enhanced cutting action. In one or more embodiments, the pedals increase the overall lateral width and the surface area of the projectile compared to the shape of the projectile before the multiple pedals are formed.

Embodiments of the disclosure provide benefits from a polymer tip with improved retention characteristics. For example, one or more embodiments are directed to manufacturing an expanding projectile by insert-molding the tip into an existing central cavity in the projectile body. In some instances, the tip includes a retention portion that completely fills the central cavity for improved retention characteristics resulting from increased friction, adhesion, and other factors. Additionally, in some embodiments the polymer tip is insert molded around an exterior side portion of the projectile and retained in place by a tip retention portion that engages with exterior structural characteristics of the metal jacket. Accordingly, embodiments of the disclosure allow for use of polymer tips in a variety of expanding projectiles, including those having a relatively shallow central cavity that makes implementation of conventional polymer tips difficult.

Additionally, embodiments of the disclosure reduce the amount of polymer required to retain the tip in place, increasing the amount of dense core material in the projectile body. Accordingly, embodiments of the disclosure assist to offset mass eccentricities in the projectile due to asymmetrical core conditions, and improve the strength, density, penetration characteristics of the projectile. Further, one or more embodiments allow for polymer tips to be molded into a projectile body including external jacket skives and other features to reduce external-ballistics drag penalties.

In one or more embodiments, an insert-molded expanding projectile comprises a projectile body including a metal jacket extending from a tail portion to a nose portion and surrounding an interior solid core. The metal jacket may be tapered at the nose portion to an annular forward edge defining an opening to a forward facing interior surface of the interior solid core. The projectile body may include an interior cavity extending from the opening to a cavity end point within the body. The interior cavity may be defined by the forward facing interior surface and an interior surface of the metal jacket forward of the forward facing interior surface.

One or more embodiments include an insert-molded elastomer portion filling the interior cavity from the cavity end point to a fill point forward of the cavity end point. The insert-molded elastomer portion may have a forward facing elastomer surface. The forward facing elastomer surface and the interior surface of the metal jacket may define an undercut interior cavity extending from the opening to the forward facing elastomer surface. One or more embodiments include an insert-molded polymer tip having an exterior surface substantially flush with an exterior surface of the metal jacket. The insert-molded polymer tip may have a main portion forward of the opening and a widening tip retention portion filling the undercut interior cavity. The widening tip retention portion may have a shape corresponding to the undercut interior cavity to retain the insert-molded polymer tip in place.

In one or more embodiments, an insert-molded expanding projectile comprises a projectile body including a metal jacket extending from a tail portion to a nose portion and surrounding an interior solid core. In one or more embodiments, the metal jacket is tapered in a forward direction at the nose portion, the metal jacket being tapered at a first rate up to a forward portion of nose portion and the metal jacket being tapered at a second rate greater than the first rate up to an annular forward edge. In one or more embodiments, the forward portion of the nose portion defines a forward facing annular ridge and the annular forward edge defines an opening in the metal jacket to a forward facing surface of the interior solid core. In one or more embodiments, the metal jacket includes an outwardly extending annular flange at the annular forward edge. In one or more embodiments the insert-molded expanding projectile includes an insert-molded polymer tip having an exterior surface substantially flush with an exterior surface of the projectile. The insert-molded polymer tip may have a main portion forward of the opening and an annular tip retention portion enclosing the forward portion and filling the forward facing annular ridge whereby the exterior surface of the insert-molded polymer tip tapers at the first rate up to a most forward tip portion of the insert-molded polymer tip and whereby the annular tip retention portion has a shape corresponding to the exterior surface of the metal jacket at the forward portion and to the annular flange to retain the insert-molded polymer tip in place.

In one or more embodiments, an insert-molded expanding projectile comprises a projectile body including a metal jacket extending from a tail portion to a nose portion and surrounding an interior solid core. In one or more embodiments, the metal jacket is tapered in a forward direction at the nose portion. In one or more embodiments, the metal jacket is tapered at a first rate up to a forward portion of nose portion and the metal jacket is tapered at a second rate greater than the first rate up to an annular forward edge. In one or more embodiments, the annular forward edge defines an opening in the metal jacket to a forward facing interior surface of the interior solid core. In one or more embodiments, the projectile body includes an undercut interior cavity extending from the opening to the forward facing interior surface, the undercut interior cavity being defined by the forward facing interior surface and an interior surface of the metal jacket forward of the forward facing interior surface. In one or more embodiments, the insert-molded expanding projectile includes an insert-molded polymer tip having an exterior surface substantially flush with an exterior surface of the projectile and the insert-molded polymer tip has a main portion forward of the opening and a tip retention portion enclosing the forward portion and filling the forward facing annular ridge, whereby the exterior surface of the insert-molded polymer tip tapers at the first rate up to a most forward tip portion of the insert-molded polymer tip. In one or more embodiments, the annular tip retention portion has a shape corresponding to the exterior surface of the metal jacket at the forward portion, and the tip retention portion filling the undercut interior cavity. In one or more embodiments, the tip retention portion having a widening shape corresponding to the undercut interior cavity to retain the insert-molded polymer tip in place.

In one or more embodiments, an insert-molded expanding projectile comprises a lead-free body having a nose portion, a tail portion, an exterior surface, and an interior portion, the nose portion tapered in a forward direction to an annular forward edge. In one or more embodiments, the annular forward edge defines an opening to a cavity in the nose portion and the cavity extends in a rearward direction from the opening to a cavity end point within the lead-free body. In one or more embodiments, the insert-molded expanding projectile further includes an insert-molded elastomer portion and an insert-molded polymer tip. The insert-molded elastomer portion fills the cavity from the cavity end point to a fill point forward of the cavity end point. In one or more embodiments, the insert-molded elastomer portion has a forward facing elastomer surface and the forward facing elastomer surface and an interior surface forward of the forward facing elastomer surface define a first portion of the cavity extending from the opening to the forward facing elastomer surface. In one or more embodiments, the first portion has a frustoconical shape. The insert-molded polymer tip has an exterior surface substantially flush with an exterior surface of the projectile. In one or more embodiments, the insert-molded polymer tip has a main portion forward of the opening and a tapering tip retention portion filling the first portion of the cavity and the tapering tip retention portion has a shape corresponding to the first portion of the cavity to retain the insert-molded polymer tip in place.

In one or more embodiments, a method of forming a projectile comprises arranging for a coil C of metal wire to be shipped from a first geographic location to a second geographic location. In one or more embodiments, the metal wire has a standard wire gauge such as a wire gauge listed in the American Wire Gauge (AWG) system. In one or more embodiments, the first geographic location and the second geographic location are separated by a distance of more than 500 miles. The method may further include feeding a length of the metal wire through a plurality of rollers R to straighten the metal wire. The metal wire is cut to form a billet having a billet length BL and a billet diameter BD. The billet is place in a lumen defined by a first die. In one or more embodiments, the lumen has a lumen diameter LD that is greater than the billet diameter BD and a lumen length LL that is greater than the billet length BL. A pin is positioned in the lumen defined by a first die on a first side of the billet and a tool is positioned in the lumen defined by the first die on a second side of the billet so that the billet is disposed between the pin and the tool. One of the tool and the pin is moved toward the other of the tool and the pin so that the billet is squeezed between the tool and the pin thereby deforming the billet to form a workpiece. In one or more embodiments, the workpiece has workpiece diameter WD that is greater than the billet diameter BD and a workpiece length WL that is smaller than the billet length BL. The method may also include placing the workpiece in a die cavity defined by a second die. In one or more embodiments, the die cavity has a tapered surface and the tapered surface has a taper radius that decreases as the tapered surface extends in a forward direction F. An end of a drive pin is inserted into the die cavity. The drive pin may be used to push the workpiece against the tapered surface so that a forward portion of the workpiece is deformed to form a projectile body.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
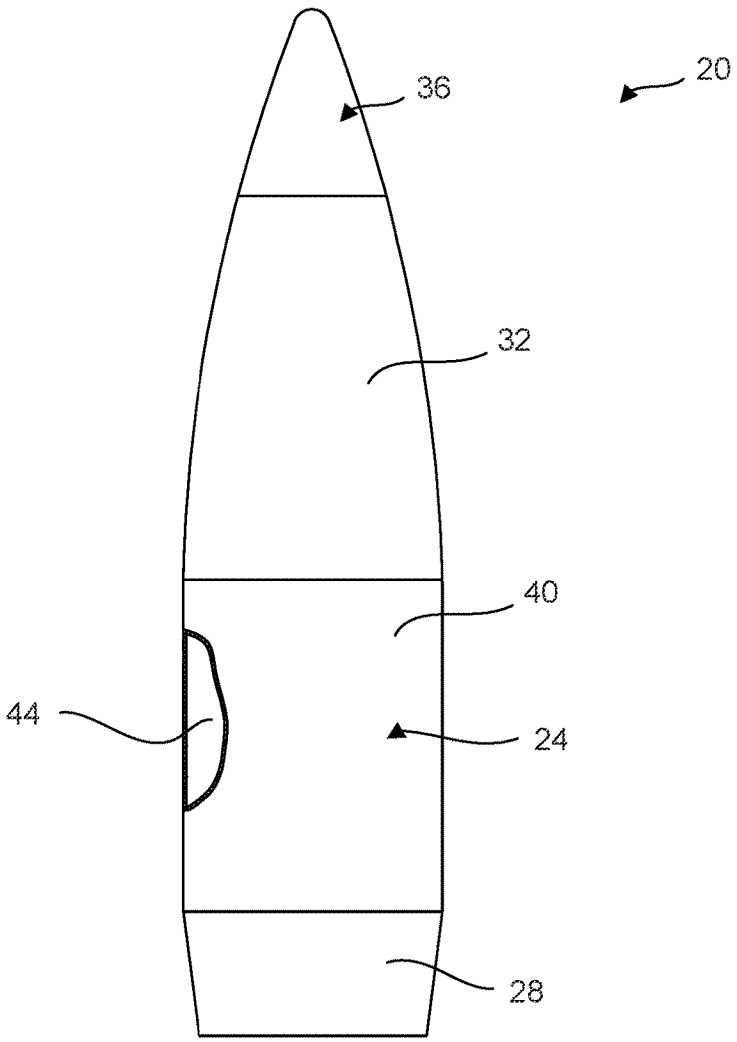
FIG. 1 depicts a side view of an expanding projectile, according to one or more embodiments.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring to FIG. 1, a side view of an expanding projectile 20 is depicted according to one or more embodiments. The projectile 20 includes a projectile body 24 having a tail portion 28 and a nose portion 32. Additionally, the projectile 20 includes a polymer tip 36 at a forward location of the nose portion 32.

In one or more embodiments, the projectile 20 is jacketed or plated, having a projectile body 24 composed of at least two parts including a metal jacket 40 surrounding an interior sold core 44 depicted in FIG. 1 under a cutaway portion of the metal jacket 40. The metal jacket 40 is a continuous piece of metal extending from the tail portion 28 to the nose portion 32, and defines the exterior the expanding projectile 20. Described further herein, the interior solid core 44, is composed of a malleable material, relative to the metal jacket 40 for expansion of the projectile body 24 upon impact with a target. In some embodiments, the interior solid core 44 is composed of lead, alloyed lead, or other suitable core material for expansion of the projectile body 24 upon impact. In various embodiments, the metal jacket 40 is composed of unalloyed copper, a copper alloyed with another metal, or other suitable projectile jacketing or plating material. For example, the metal jacket 40 may be composed of a copper-zinc alloy for covering the interior solid core 44 while firing of the projectile from a barrel.

In some embodiments, the projectile 20 is a lead-free projectile, where the projectile body 24 is a single, unitary piece of non-lead material. For example, in some embodiments, the body 24 is entirely composed of unalloyed copper, a copper alloyed with another metal, or other suitable non-lead material.

Figure 2A:
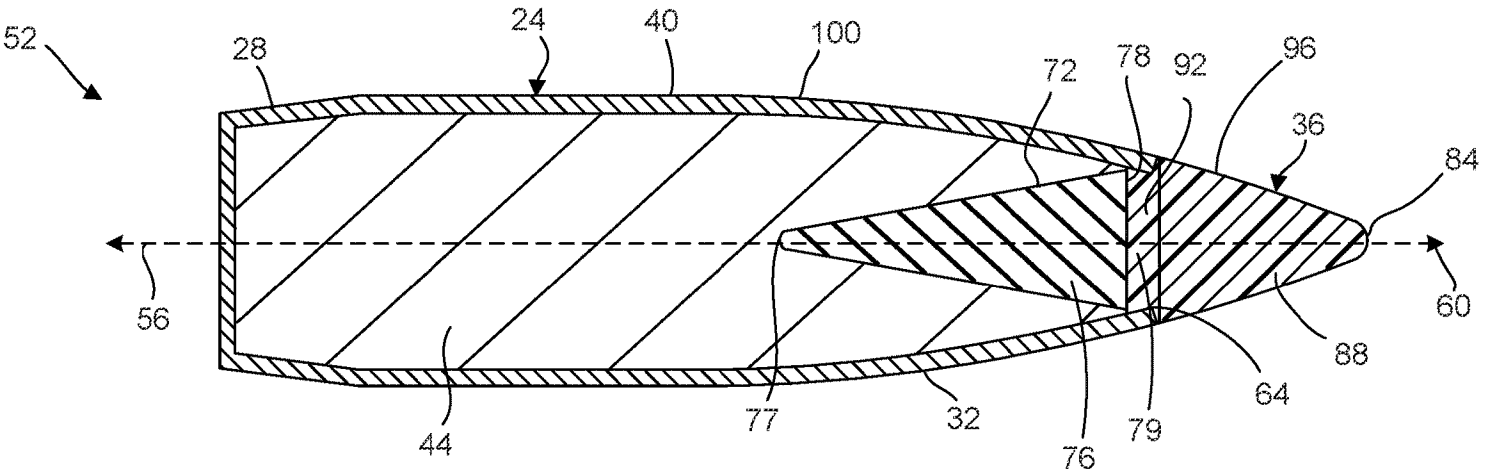
FIGS. 2A & 2B depict a cross-section views of an expanding projectile, according to one or more embodiments.
Figure 2B:
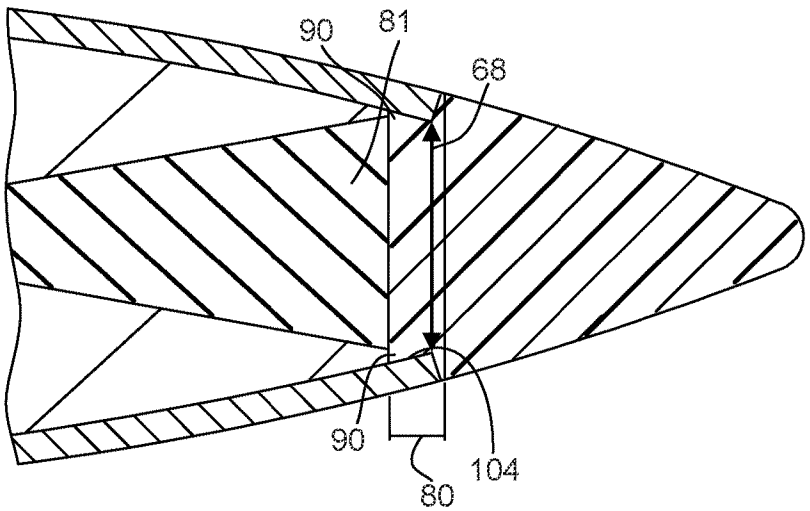

Referring to FIGS. 2A-2B, cross-section views of an expanding projectile 52 are depicted, according to one or more embodiments of the disclosure. In various embodiments, expanding projectile 52 shares one or more like elements with the expanding projectile 20 of FIG. 1. Like elements are referred to with the same reference numbers.

Expanding projectile 52 is jacketed, including a projectile body 24 composed of a metal jacket 40 extending from the tail portion 28 to the nose portion 32 and surrounding an interior solid core 44. The metal jacket 44 and nose portion 32 tapers in a forward direction, indicated by arrow 60 on a central axis 56. The metal jacket 40 extends to an annular forward edge 64 that defines an opening 68 in the metal jacket 40 to expose the interior solid core 44 and a forward facing interior surface 72. The interior solid core 44 is composed of a relatively malleable material so that, upon impact, the interior core material is compressed rearwardly, and the projectile 52 expands or mushrooms for increased transfer of kinetic energy to a target. In certain embodiments, the forward facing interior surface 72 is substantially flat surface normal to the central axis 56. However, in some embodiments, the interior surface 72 may be asymmetrical, have a central indentation or depression, or may have other shape based on the design of the projectile 52, based on manufacturing variations, or on other factors.

In one or more embodiments, the expanding projectile 52 includes a central cavity 76 extending from the opening 68 to a cavity end point 77 in the projectile body 24. In various embodiments, the central cavity is a conical indentation or other indented shape in the interior solid core 44 for enhancing mushrooming characteristics of the expanding bullet 52. In some embodiments, the central cavity 76 is defined by the forward facing interior surface 72 and interior surface 104 of the metal jacket 40, forward of the forward facing interior surface. An insert-molded elastomer portion 81 fills the cavity 76 from the cavity end point 77 to a fill point at the forward portion 80 of the projectile body 24. The elastomer portion 81 defines a forward facing elastomer surface 78 at the fill point.

The forward portion 80 of the projectile body 24 including the forward facing elastomer surface 78 and an interior surface of the metal jacket 40 forward of the forward facing elastomer surface 78 may define an undercut central cavity 79. In one or more embodiments, the undercut central cavity 76 has an undercut shape, as the forward portion 80 of the metal jacket 40 tapers from the elastomer surface 78 to the opening 68, such that the opening 68 has a diameter smaller than that of the elastomer surface 78 and defines undercut corner regions 90. The undercut region defined as the portion of the cavity 76 exterior to an axially extending cylinder with the radius of the opening 68. In various embodiments, the undercut central cavity 79 may be relatively shallow, extending rearwardly from the opening a small percentage of the total length of the projectile body 24. In some embodiments, the depth of the undercut central cavity 79 is substantially in the range of 5% to 20% the length of the projectile body 24. In some embodiments the undercut central cavity 79 has a depth substantially in the range of 2 millimeters (mm) to 10 mm.

In one or more embodiments, the expanding projectile 52 includes a polymer tip 36 defining a most forward tip portion 84 for the projectile 52. The polymer tip 36 is a unitary structure including a main portion 88 and a widening tip retention portion 92 rearward of the opening 68. The polymer tip 36 has an exterior surface 96 substantially flush with an exterior surface 100 of the expanding projectile 52 for forming a relatively streamlined or spitzer aerodynamic shape. In one or more embodiments, the tip retention portion 92 is a portion of the polymer tip 36 that conforms to one or more structural features of the projectile body 24 for retention of the polymer tip 36 within the expanding projectile 52.

For example, depicted in FIGS. 2A-2B, the tip retention portion 92 fills the undercut interior cavity 76, having a shape that corresponds to the undercut interior cavity 76. The tip retention portion widens from the opening 86, abutting the interior surface 104 of the metal jacket, filling the undercut corner portions 90 and abutting the forward facing interior surface 72. By conforming to the shape of the undercut interior cavity 76, the widening tip retention portion 92 forms a widened plug shaped element which resists axial movement of the polymer tip 36 and retains it in place connected to the projectile body 24. Accordingly, projectile 52 includes two types of polymers in the form of the embedded elastomer portion 81 completely covered by the polymer tip 36. In various embodiments, the elastomer portion 81 is generally softer than the polymer tip 36, having a generally lower durometer measurement.

Described further herein, in various embodiments, the polymer tip 36 is formed via an insert-molding process where the body 24 is located in an injection mold and a thermoplastic is injected into the cavity 76 and mold to form the polymer tip 36. In some embodiments, the polymer tip 36 is retained in place in part due to adhesion between the projectile body and the polymer tip 36 from the insert molding and solidifying process.

Figure 3A:
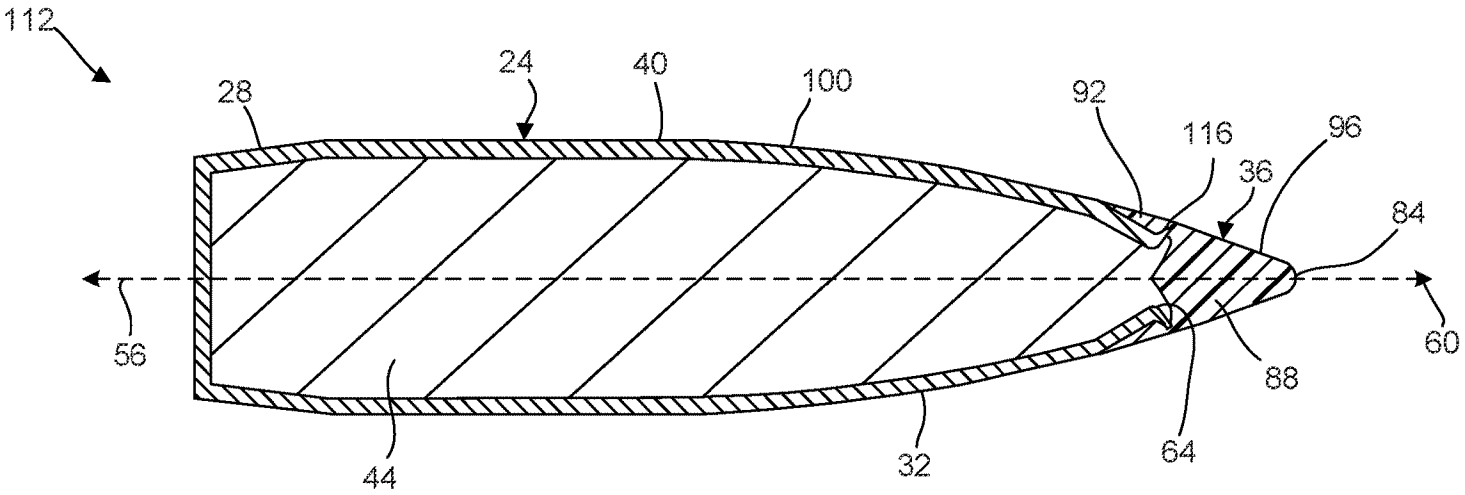
FIGS. 3A & 3B depict cross-section views of an expanding projectile, according to one or more embodiments.
Figure 3B:
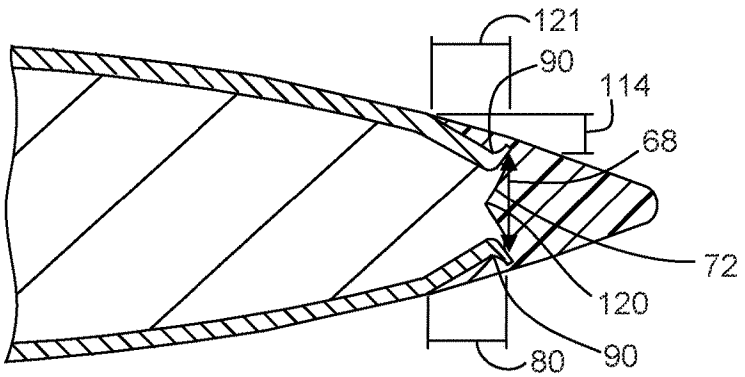

Referring to FIGS. 3A-3B, cross-section views of an expanding projectile 112 are depicted according to one or more embodiments of the disclosure. In various embodiments, expanding projectile 112 shares one or more like elements with the expanding projectiles 20, 52 of FIGS. 1, 2A, and 2B. Like elements are referred to with the same reference numbers.

Expanding projectile 112 is jacketed, including a body 24 composed of a metal jacket 40 extending from the tail portion 28 to the nose portion 32 and surrounding an interior solid core 44. In one or more embodiments, the metal jacket 40 and nose portion 32 is tapered at a first rate, up to a forward portion 80 where the metal jacket 40 nose portion tapers at a greater rate to an annular forward edge 64. As such, the metal jacket 40 and nose portion define a forward portion 80 having an annular ridge 114 surrounding the forward portion 80 of the nose portion 32. In one or more embodiments, the annular forward edge 64 includes an annular flange 116 included as a portion of the metal jacket 40, extending outwardly from the metal jacket 40. In various embodiments, the forward portion 80 and the annular forward edge 64 define an exterior undercut shape 121 including undercut portions 90 at the exterior of the metal jacket 40.

The metal jacket 40 terminates at the annular forward edge 64 and defines an opening 68 exposing the interior solid core 44 and a forward facing interior surface 72. Depicted in FIGS. 3A-3B, the interior solid core 44 extends from the nose portion 32 to the forward annular edge 64 and defines the interior surface 72 substantially aligned with the annular forward edge 64. Additionally, the interior surface 72 is includes a central depression or indentation 120 for promoting mushrooming characteristics of the projectile 112 upon impact with a target. However, in some embodiments, the interior surface 72 may be substantially flat, asymmetrical, include a cavity, or have other shape based on the design of the projectile 112, manufacturing variations, or other factors.

In one or more embodiments, the expanding projectile 112 includes a polymer tip 32 defining a most forward projectile tip 84 and an exterior surface 96 substantially flush with an exterior surface 100 of the nose portion 32 for forming a generally streamlined or spitzer aerodynamic shape.

The polymer tip 32 includes a main portion 88 and an annular tip retention portion 92 rearward of the opening 68. The annular tip retention portion 92 is disposed around the exterior 100 of the projectile body 24 at the forward portion 80. The annular tip retention portion 92 surrounds the forward portion 80 and fills in the ridge 114 and mirrors the shape of the exterior undercut shape 121. Additionally, in some embodiments, the exterior surface 96 follows the taper at the first rate from the nose portion 32 to the forward tip 84.

As such, the polymer tip 36 forms a unitary structure having the forward main portion 88 and the annular tip retention portion 92 filling in an exterior undercut portion 121 to resist axial movement of the polymer tip 36 away from the projectile body 24. In various embodiments, the polymer tip 36 is formed via an insert-molding process where at least the forward portion 80 of the body 24 is located in an injection mold and a thermoplastic is injected into the mold and onto the forward portion 80 and cooled to form a solidified polymer tip 36 and the tip retention portion 92. In some embodiments, the polymer tip 36 is further retained in place in part due to adhesion between the projectile body and the polymer tip 36 from the insert molding and solidifying process.

Figure 4A:
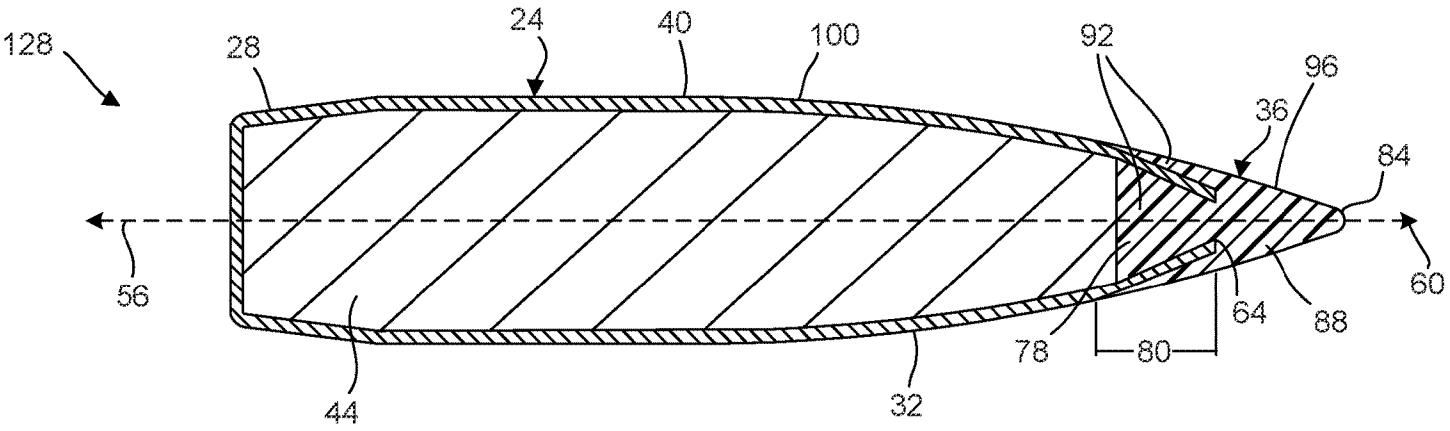
FIGS. 4A & 4B depict cross-section views of an expanding projectile, according to one or more embodiments.
Figure 4B:
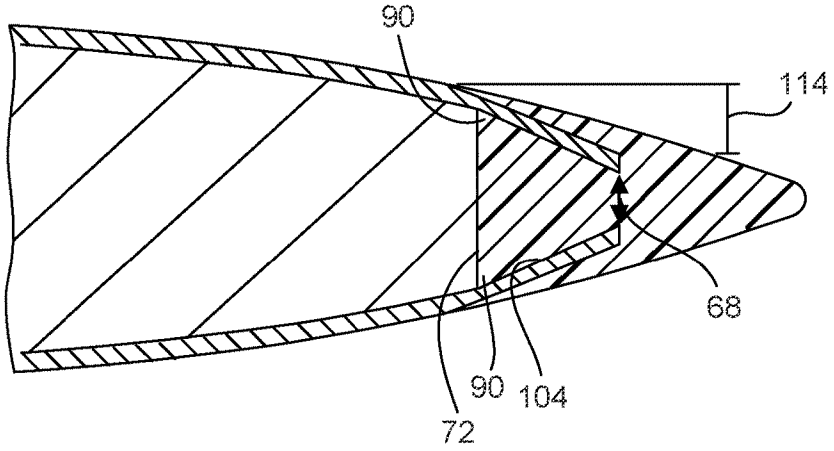

Referring to FIGS. 4A and 4B, cross-section views of an expanding projectile 128 are depicted according to one or more embodiments. In various embodiments, expanding projectile 128 shares one or more like elements with the expanding projectiles 20, 52, and 152 of FIGS. 1, 2A-2B, and 3A-3B. Like elements are referred to with the same reference numbers.

Expanding projectile 128 is jacketed, including a body 24 composed of a metal jacket 40 extending from the tail portion 28 to the nose portion 32 and surrounding an interior solid core 44. The metal jacket 40 and defines an opening 68 at an annular forward edge 64 exposing the interior solid core 44 and a forward facing interior surface 72. Depicted in FIGS. 4A-4B, the an undercut central cavity 76 is included in the projectile body 24 extending from the opening 68 to the forward facing interior surface 72. In one or more embodiments, the undercut interior cavity 76 is defined by a forward portion 80 of the projectile body 24 including the forward facing interior surface 72 and interior surface 104 of the metal jacket 40, forward of the forward facing interior surface 72. The undercut central cavity 76 has an undercut shape, where the opening 68 has a diameter smaller than that of the interior surface 72 to define undercut corner portions 90 between the metal jacket 40 and the forward facing interior surface 72.

Additionally, the metal jacket 40 and nose portion 32 are tapered at a first rate, up to a forward portion 80 where the metal jacket 40 nose portion tapers at a greater rate to the annular forward edge 64. As such, the metal jacket 40 and nose portion define a forward portion 80 having an annular ridge 114 surrounding the forward portion 80 of the nose portion 32.

In one or more embodiments, the expanding projectile 128 includes an insert-molded polymer tip 36 defining a most forward projectile tip 84 and an exterior surface 96 substantially flush with an exterior surface 100 of the projectile for forming a generally streamlined or spitzer aerodynamic shape.

The polymer tip 32 includes a main portion 88 and a tip retention portion 92 rearward of the opening 68. Depicted in FIGS. 4A-4B, the tip retention portion 92 fills the undercut interior cavity 76, and has a shape corresponding to the undercut shape of the interior cavity. By conforming to the shape of the interior cavity 76, the tip retention portion 92 forms a plug shaped element which resists axial movement of the polymer tip 36 and retains it in place connected to the projectile body 24.

Additionally, the tip retention portion 92 is disposed around the exterior of the projectile body 24 at the forward portion 80 and abuts the exterior 100 of the metal jacket 40. The tip retention portion 92 surrounds the forward portion 80 and "fills" in the ridge 114, continuing the taper from the nose portion 32 to the forward tip 84. As such, tip retention portion 92 increases the surface contact with the metal jacket 40, which improves retention of the polymer tip due to adhesion with the metal jacket and frictional forces between the polymer tip 32 and the jacket 40.

Figure 5A:
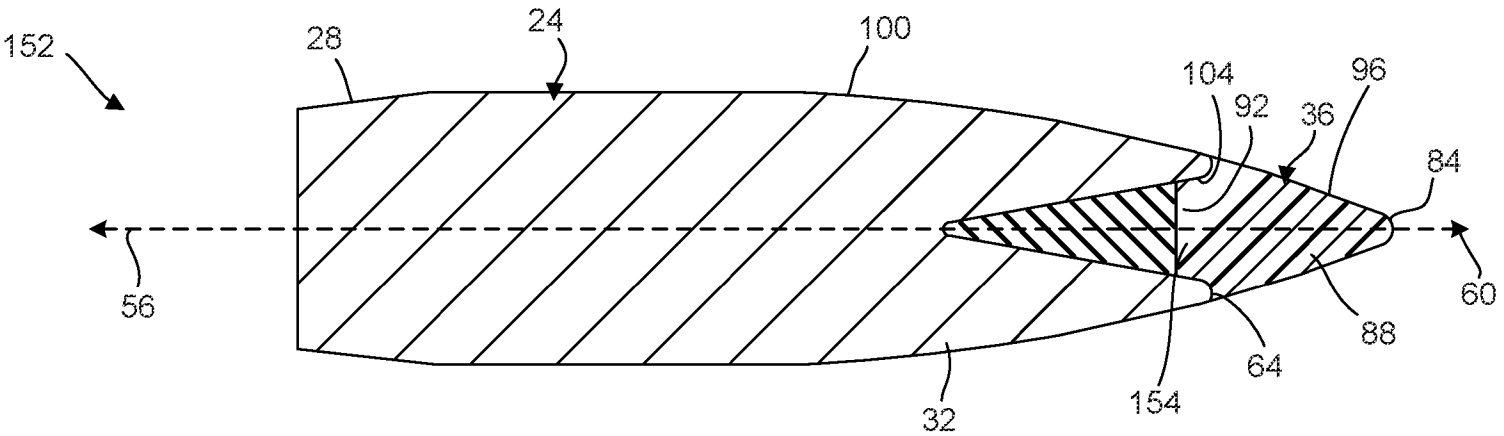
FIGS. 5A & 5B depict cross-section views of a lead-free expanding projectile, according to one or more embodiments
Figure 5B:
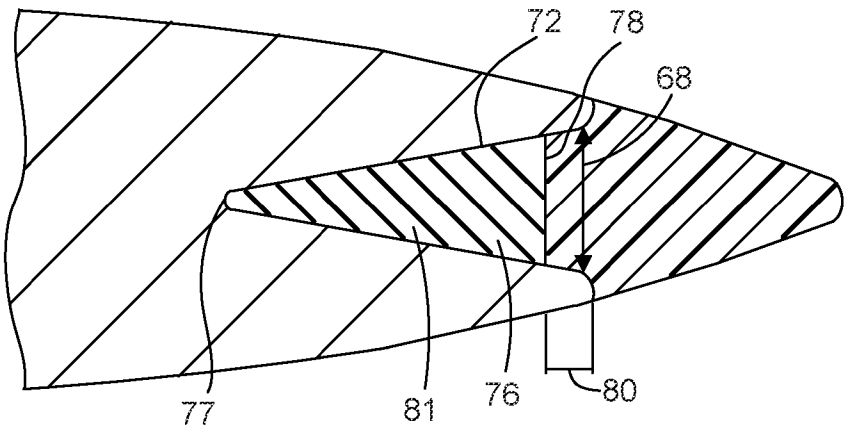

Referring to FIGS. 5A and 5B, an expanding projectile 152 is depicted, according to one or more embodiments of the disclosure. In various embodiments, the expanding projectile 152 of FIGS. 5A and 5B shares some elements as depicted in FIGS. 1 and 2A-2B. Like elements are referred to with the same reference numbers. For example, expanding projectile 152 includes a body 24 extending from the tail portion 28 to the nose portion 32 to an annular forward edge 64 that defines an opening 68 to expose a cavity 154 in projectile body 24. Depicted in FIGS. 5A-5B expanding projectile 152 is a lead-free projectile composed of a single, unitary piece of material. For example, in some embodiments, the body 24 is entirely composed of unalloyed copper, a copper alloyed with another metal, or other suitable non-lead material. In one or more embodiments, the cavity 76 extends in a rearward direction to a cavity end point 77 within the body 24. In embodiments, the cavity 76 is designed for mushrooming the expanding projectile 152.

An insert-molded elastomer portion 81 fills the cavity 76 from the cavity end point 77 to a fill point at a forward portion 80 of the projectile 152. The elastomer portion 81 includes a forward facing elastomer surface 78 at the fill point. In one or more embodiments, the forward facing elastomer surface 78 and interior surface 104 of the projectile body 24 forward of the elastomer surface 78 define a frustoconical cavity portion 154 intermediate the opening 68 and the forward facing elastomer surface 78. In one or more embodiments, the projectile body 24 includes an insert-molded polymer tip 36 having an exterior surface 96 substantially flush with an exterior surface 100 of the projectile body 24 for forming a relatively streamlined or spitzer aerodynamic shape for the expanding projectile 152. The polymer tip 36 defines a most forward projectile tip 84 and is retained in place by a tip retention portion 92 filling the cavity 154 and abutting the forward facing elastomer surface 72 and interior surface 104 of the forward portion 80. As described, in one or more embodiments, the polymer tip 36 includes a main portion 88 and a rearward tip retention portion 92 filling the cavity 76 of the projectile body 24. In various embodiments, the tip retention portion abuts the interior surface 72 and the interior surface 104 of the projectile body 24 for retaining the polymer tip 36 place in part from adhesion, friction, or other forces resisting axial movement of the polymer tip 36 away from the projectile body 24.

Described further herein, in various embodiments, the polymer tip 36 and the elastomer portion 160 are formed via an insert-molding process where the projectile body 24 is located in a two-shot injection mold and liquid elastomer and thermoplastic are alternately injected and cooled to solidify and form the elastomer portion 81 and the polymer tip 36. Alternatively, the elastomer portion may be deposited in the cavity without a mold. Alternatively a solid elastic plug may be inserted. See US Pat Pub. 2005/0126422 which is incorporated by reference herein for all purposes.

Figure 6:
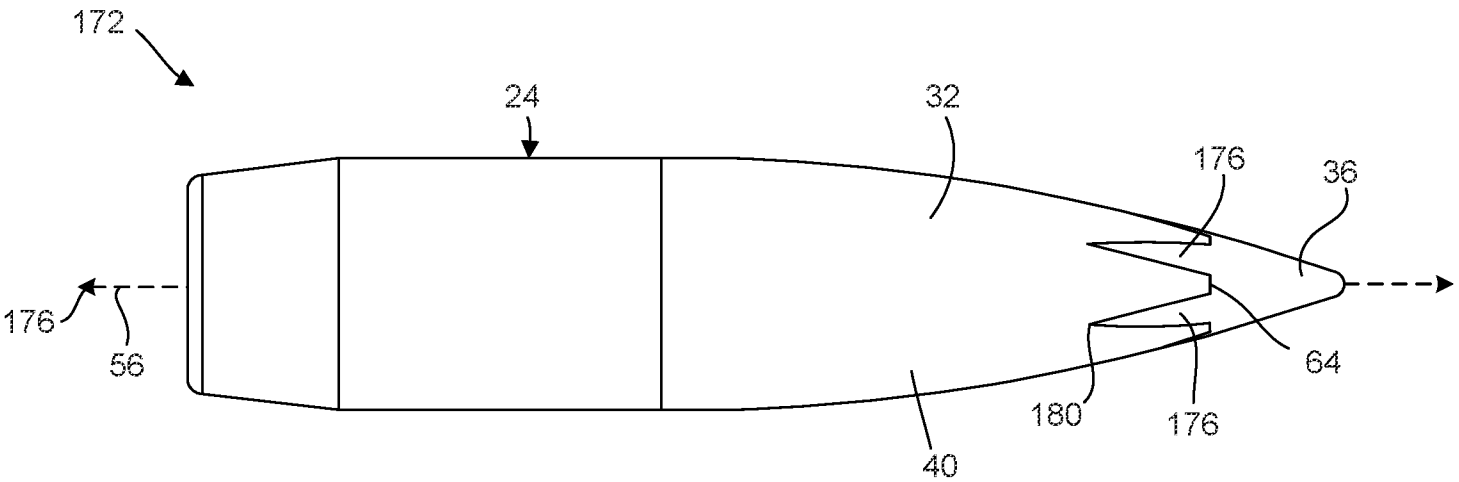
FIG. 6 depicts a side view of an expanding projectile, according to one or more embodiments.

Referring to FIG. 6, an expanding projectile 172 is depicted, according to one or more embodiments of the disclosure. Depicted in FIG. 6 the expanding projectile 172 includes a plurality of longitudinal skives 176 in the annular forward edge 64. The plurality of skives 176 are longitudinal recesses in the metal jacket 40 for improving the mushrooming or expansion characteristics of the metal jacket 176. For example, each of the skives 176 may be configured to flare outwardly from the central axis 56 upon impact with a target. The plurality of skives are spaced radially about the central axis 56 and extend in a rearward direction, indicated by arrow 176 to a point 180 in the metal jacket 40 intermediate the nose portion 32. Additionally, in some embodiments, the plurality of skives 176 may be included for aesthetic purposes, giving the expanding projectile 172 a unique look. In various embodiments, the expanding projectile includes a polymer tip 36 formed in an interior cavity in the projectile body 24. In various embodiments, the plurality of skives may be defined by a plurality of folded portions of the metal jacket which are cut away and folded inwardly towards the central axis 56. In some embodiments, the polymer tip 36 is molded onto the plurality of folds and fills the skive portions 176.

Referring to FIGS. 7A-7D various stages in a method of manufacturing an expanding projectile are depicted, according to one or more embodiments. FIGS. 7A-7D depict a cross-section view of a mold 184 including first and second mated plates 188, 192, and a projectile body 24, according to one or more embodiments. While FIGS. 7A-7D depict a mold 184 including two plates, in various embodiments, the various types of molds may be used including three-plate molds and/or multi-piece molds.

In one or more embodiments, the first and second plates 188, 192 include a moving plate and a stationary plate for configuring the mold between an open and closed arrangement. For example, in some embodiments the first plate 188 is the stationary plate and is located on the injection side of the mold, connected to a supporting plate 196 and to an injection unit 200. The first plate 188 additionally includes a sprue 204 for injection of liquid material into the mold 184 from the injection unit 200. In some embodiments the second plate 192 is a moving plate cooperatively connected to a motor for mold 184 opening and closing phases. Additionally, in some embodiments, the mold 184 includes cooling lines 208 as well as a part ejection system, such as an ejector pin 212 for ejecting the completed mold.

Figure 7A:
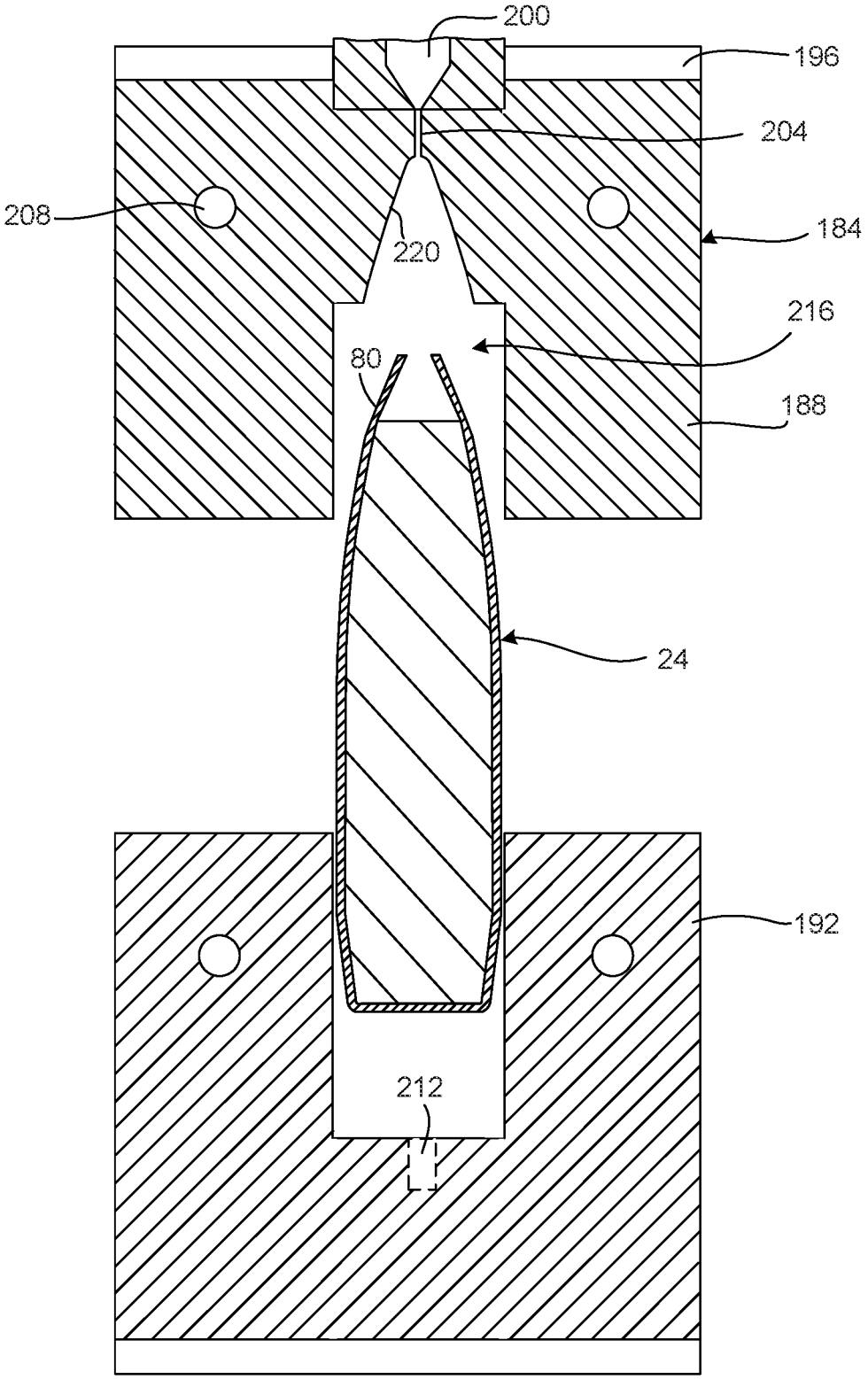
FIGS. 7A-7D depict various stages in a process of manufacturing an expanding projectile, according to one or more embodiments.

In FIG. 7A, the mold 184 is in an open configuration, where the first and second plates 188, 192 are apart to create an opening 216 for receiving the projectile body 24. The body 24 is inserted into the opening 216 and the forward portion 80 is positioned aligned with a tip mold portion 220 in the first plate 188.

Figure 7B:
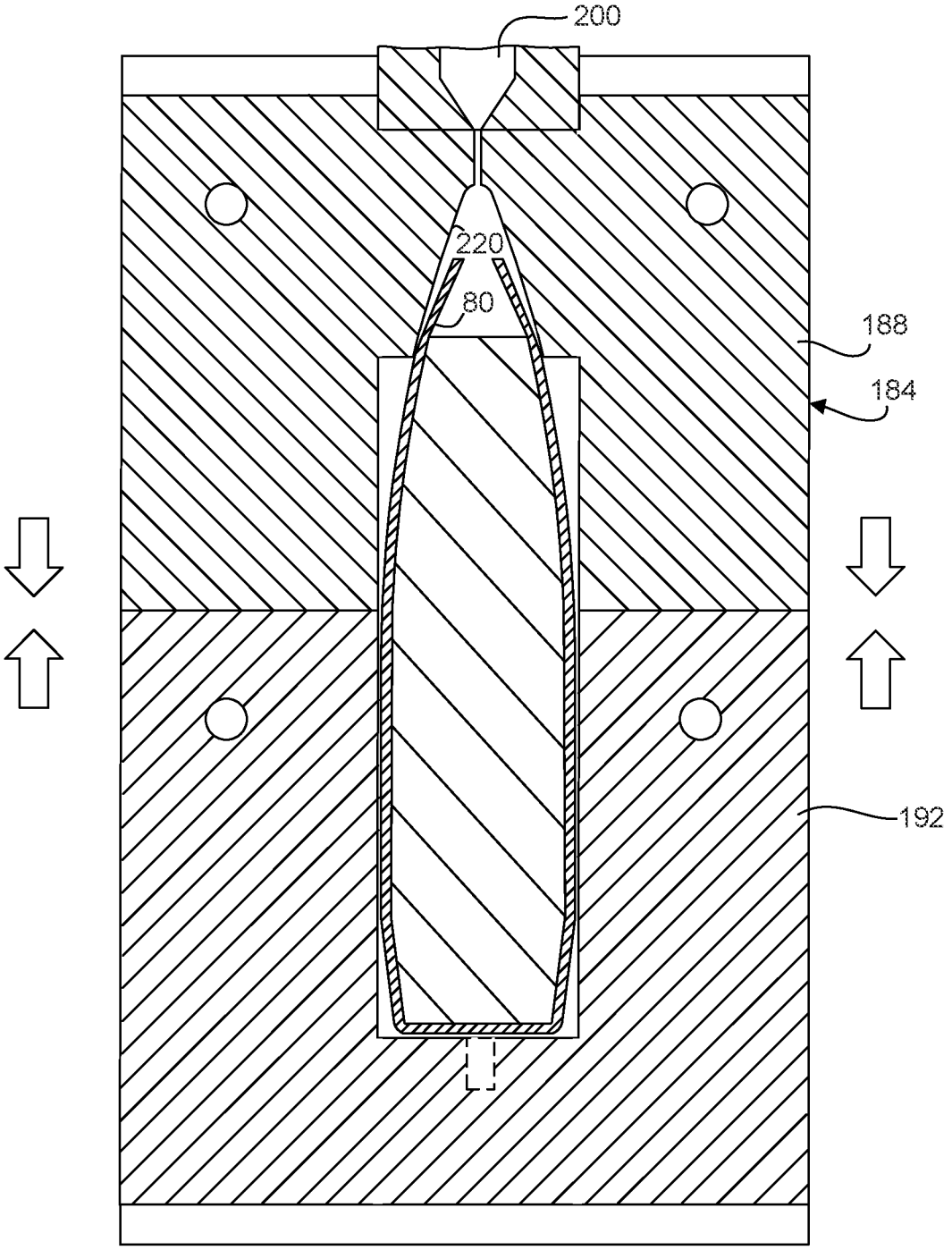

In FIG. 7B, the second plate 192 of the mold 184 closes and seals the projectile body 24 within the mold 184. The forward portion 80 of the projectile body 24 is inserted into the tip mold portion 220 substantially sealing the tip mold portion 220 from the remainder of the mold 184.

Figure 7C:
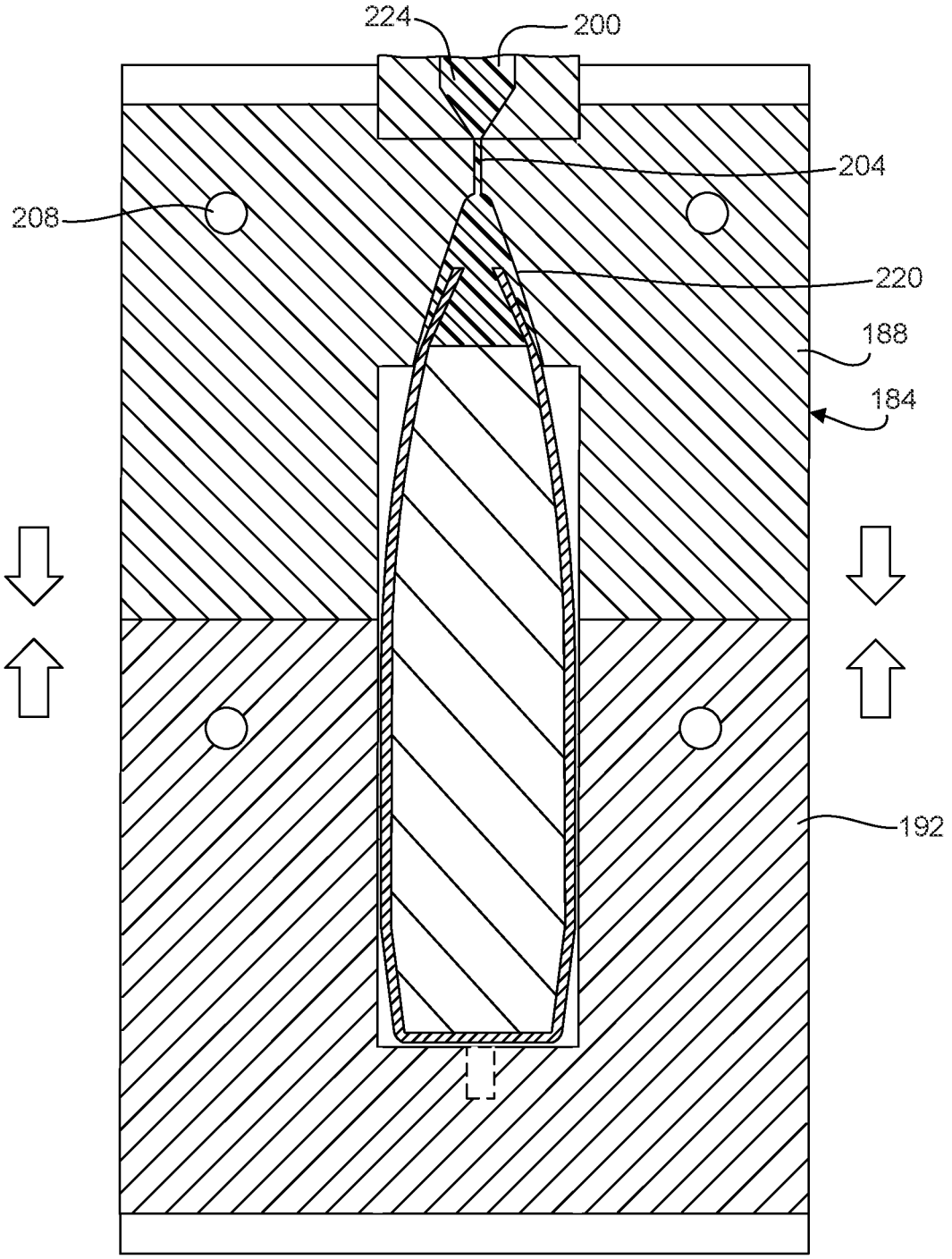

In FIG. 7C, the injection unit 200 plasticizes a plastic or polymer resin and the unit 200 feeds a thermoplastic material 224 through the sprue 204 and into the tip mold portion 220. Once injected, the mold 184 applies a holding pressure to the projectile body 24 and the injected thermoplastic material 224 to reduce potential air pockets and for completely filling the tip mold portion 220 and the projectile body 24 with thermoplastic material 224. As pressure is applied, the mold 184 and thermoplastic material 224 begins to cool and the thermoplastic material 224 begins to solidify. In one or more embodiments, cooling is expedited by convection due to coolant flowing through cooling lines 208 inside the mold 184.

Figure 7D:
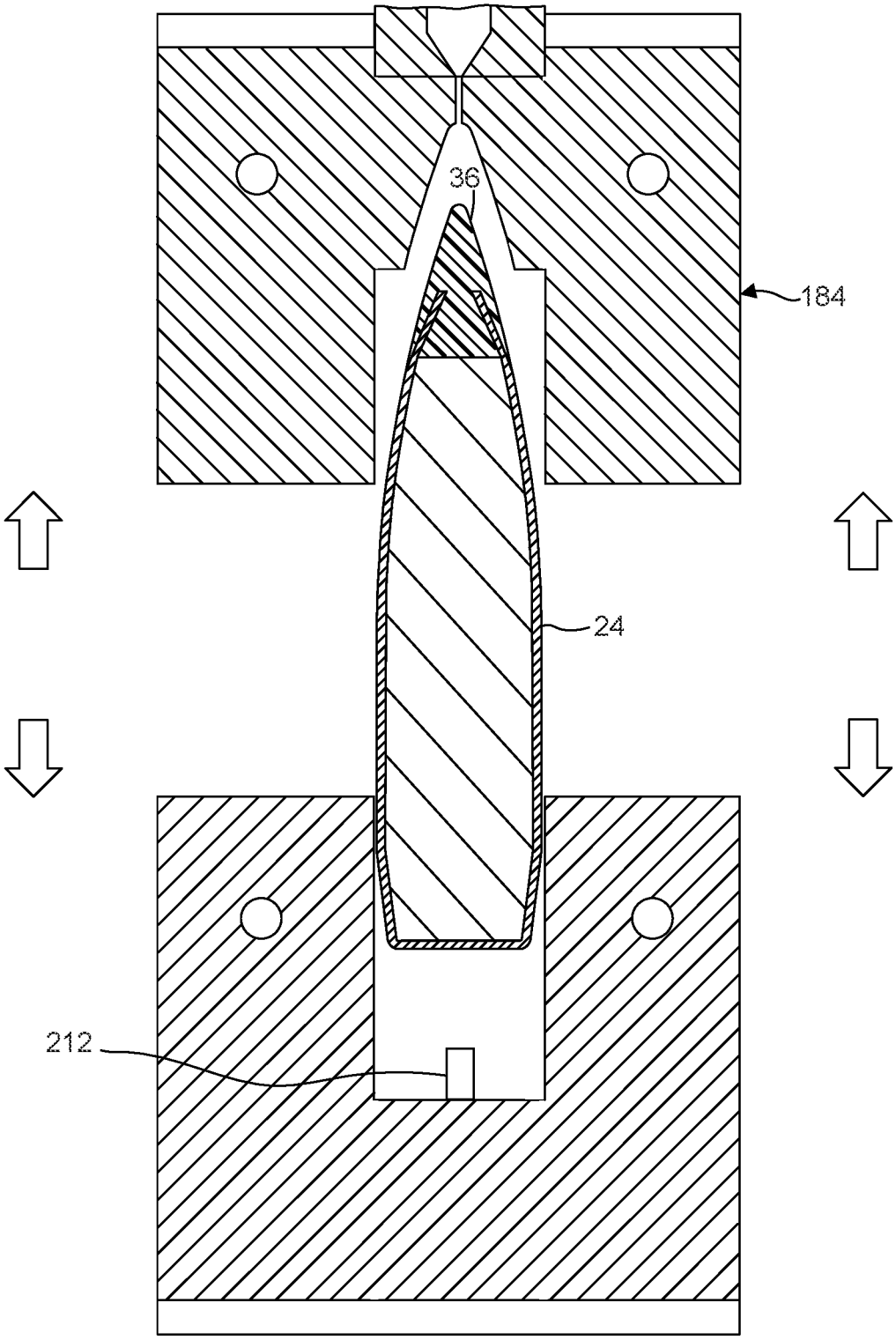

In FIG. 7D, after adequate cooling time has elapsed, the mold 184 is opened. Ejector device 212 is actuated in this process and the projectile body 24 with polymer top 36 is ejected from the mold 184 and collected. In one or more embodiments, the cycle may then repeat with another projectile body 24 inserted within the mold as depicted in FIG. 7A.

Figure 8B:
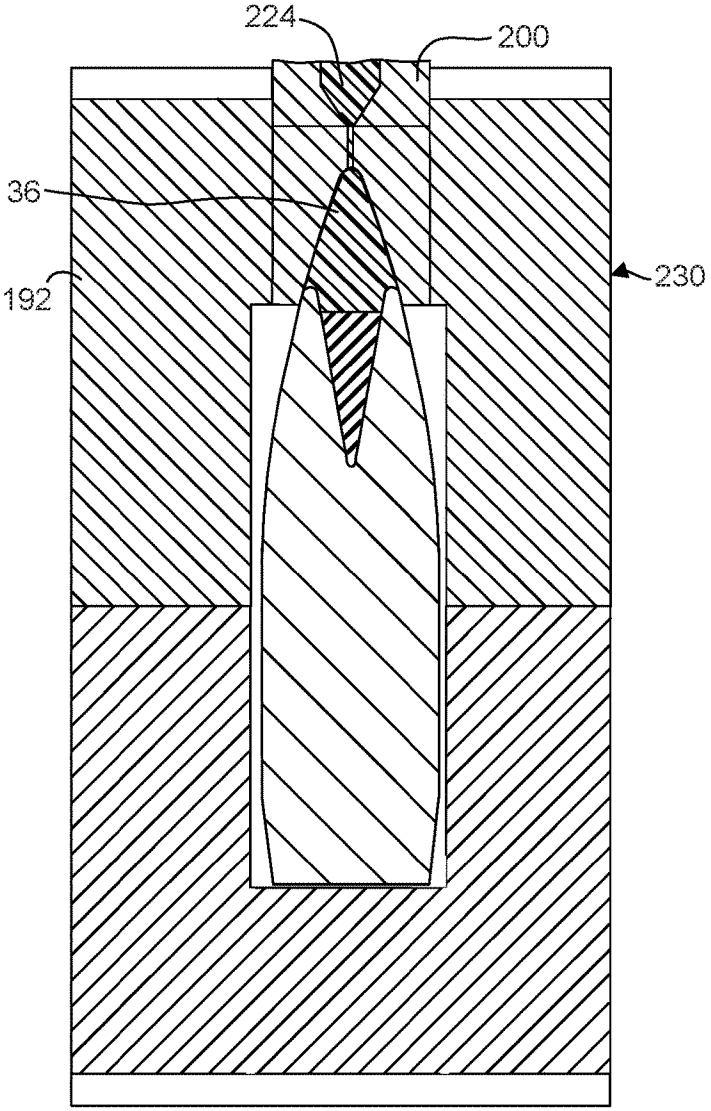
FIGS. 8A-8B depict various stages in a process of manufacturing a lead free expanding projectile, according to one or more embodiments.
Figure 8A:
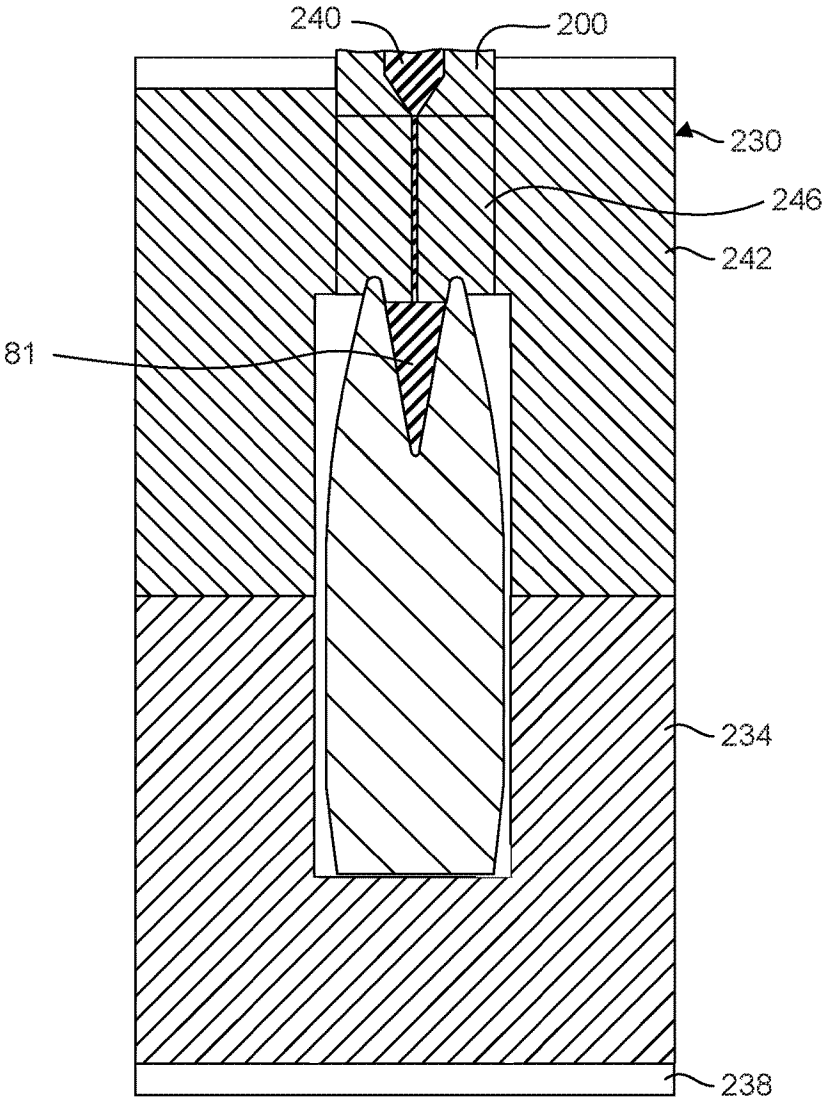

Referring to FIGS. 8A and 8B stages in a method of manufacturing an expanding projectile are depicted, according to one or more embodiments. FIGS. 8A-8B depict a cross-section view of a mold 230 and an expanding projectile 152, according to one or more embodiments. In various embodiments, the mold 230 of FIGS. 8A-8B shares some elements as mold 184 depicted in FIGS. 7A-7D. Shared elements are referred to with the same reference numbers.

FIGS. 8A-8B depicts a two shot injection process including a moveable base plate 234 mounted on a movable platform 238 and first and second stationary plates 242, 192. In various embodiments, the projectile body 24 is inserted into the mold 230 and the movable board rotates or otherwise alternates the projectile body 24 and the base plate 238 between the first and second stationary plates 242, 192. Depicted in FIG. 8A, the projectile body 24 is in alignment with an elastomer mold portion 246 configured to introduce liquid elastomer material 240 into the interior cavity 154. Injection unit 200 plasticizes elastomer material or resin and the material is fed into the projectile body 24. In some embodiments, the mold cools and solidifies the elastomer portion 81 and the moveable board 238 moves the projectile body 24 to a stage of manufacturing depicted in FIG. 8B. In certain embodiments, the elastomer portion 81 solidifies via other methods, including air exposure, chemical treatment, or other method of solidifying elastomer.

In FIG. 8B, the injection unit 200 plasticizes a plastic or polymer resin and the unit feeds a thermoplastic material 224 into the tip mold portion 220. Once injected, the mold 230 applies a holding pressure to the projectile body 24 and the mold 230 begins to cool and the thermoplastic material 224 solidifies to form a polymer tip 36.

Figure 9:
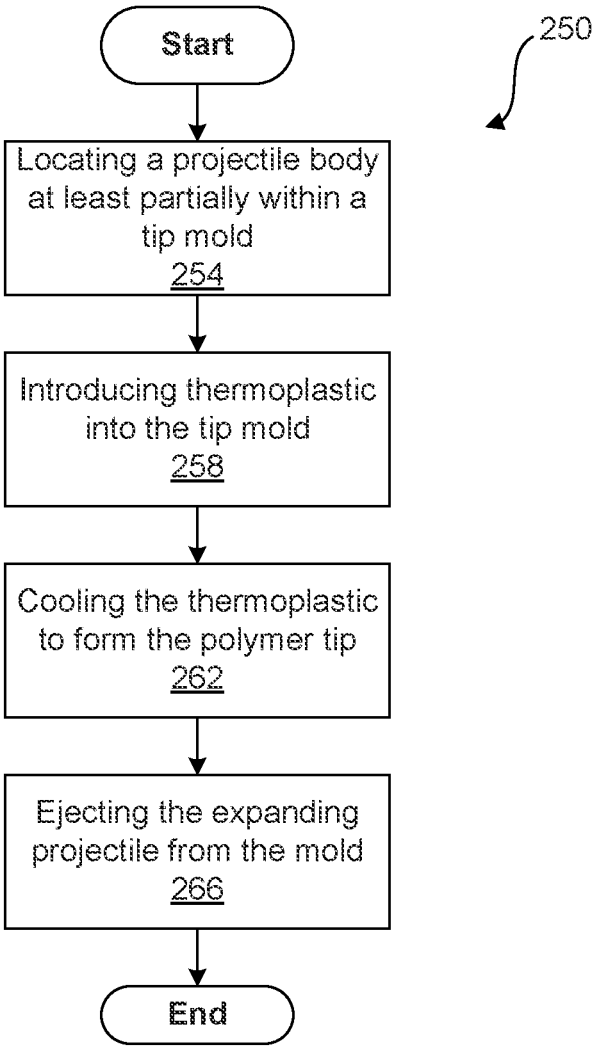
FIG. 9 depicts a flowchart diagram of a method of manufacturing an expanding projectile, according to one or more embodiments.
Figure 10A:
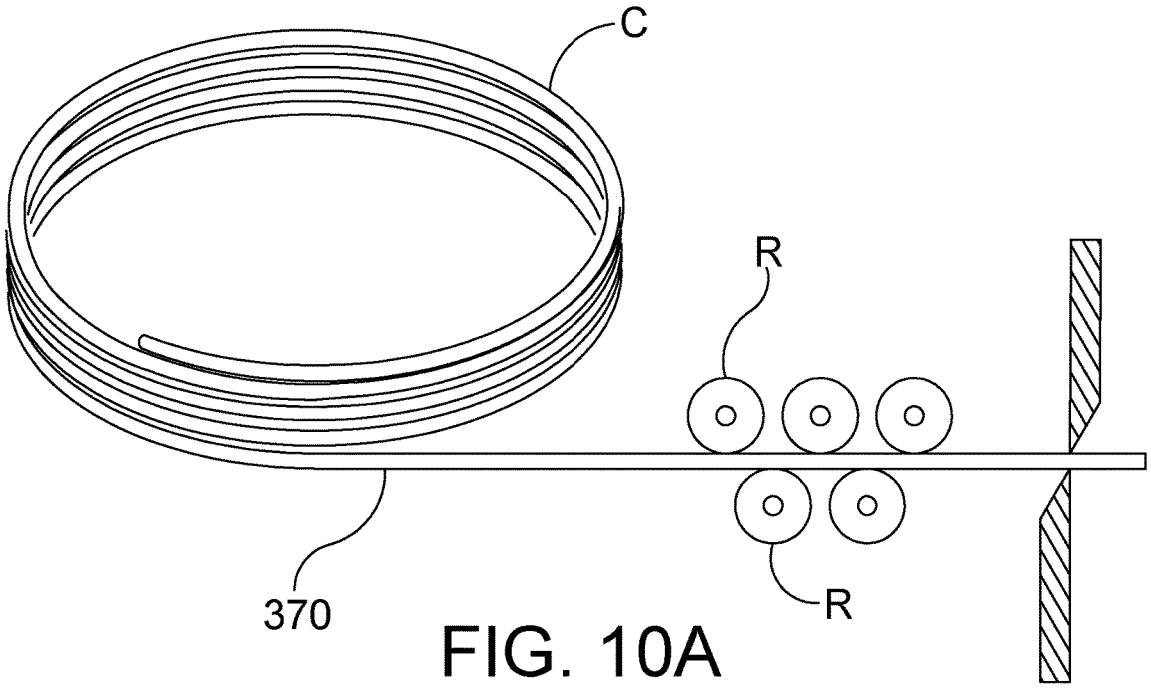
FIG. 10A is a diagram showing a coil of metal wire and a set of rollers for straightening the wire.
Figure 10B:
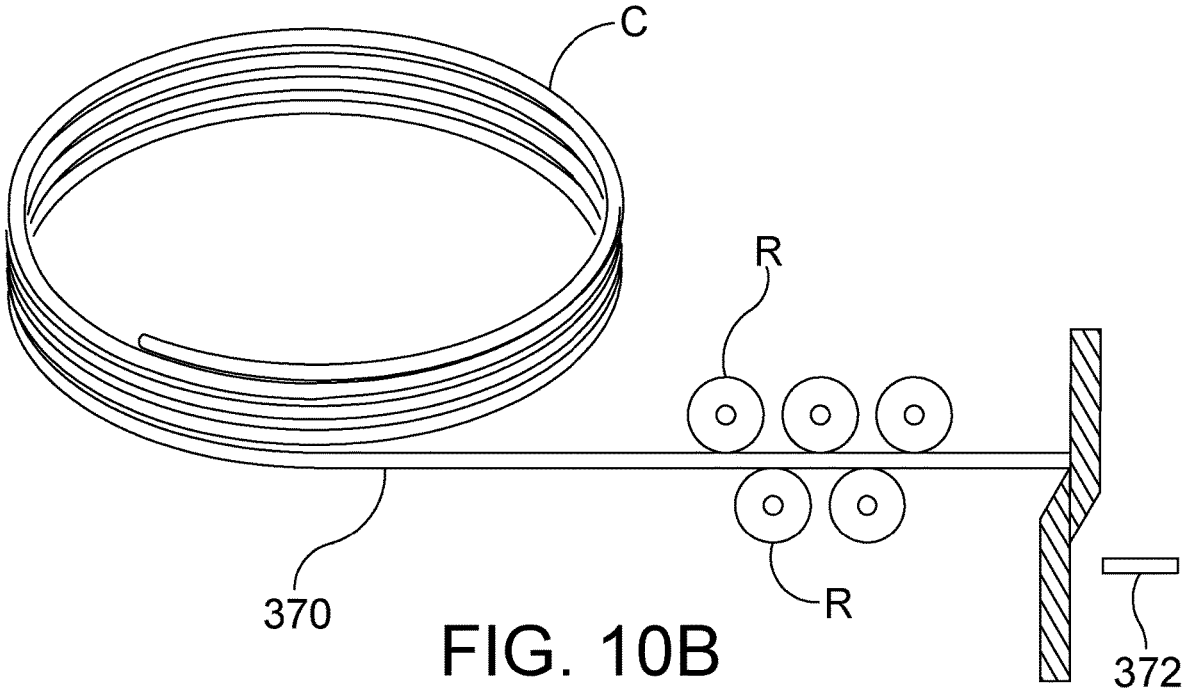
FIG. 10B is a diagram showing a length of straightened metal wire and a billet cut from the straightened metal wire.
Figure 11A:
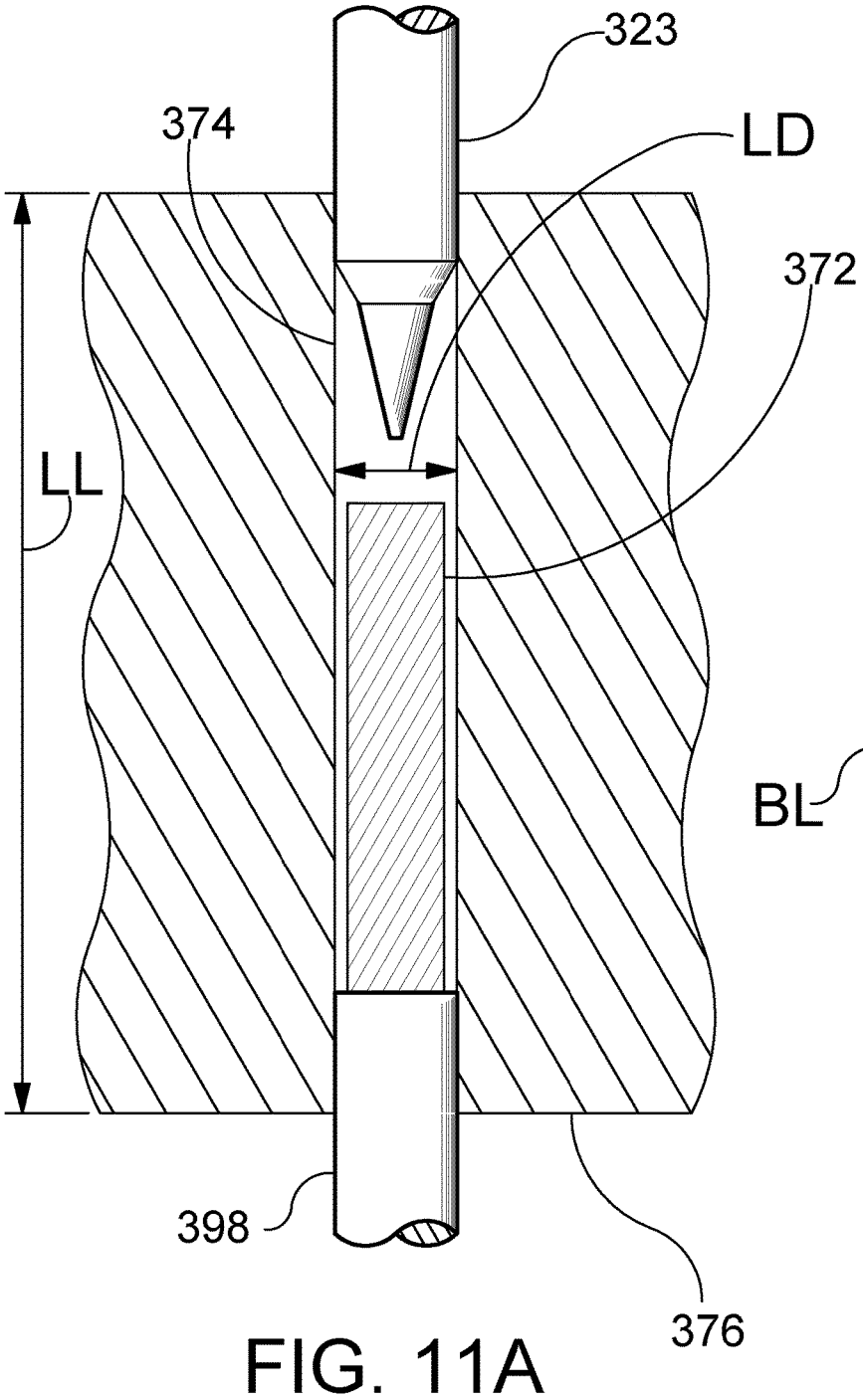
FIG. 11A is a partial cross-sectional view showing an assembly including a first die defining a lumen and a billet disposed in the lumen.
Figure 11B:
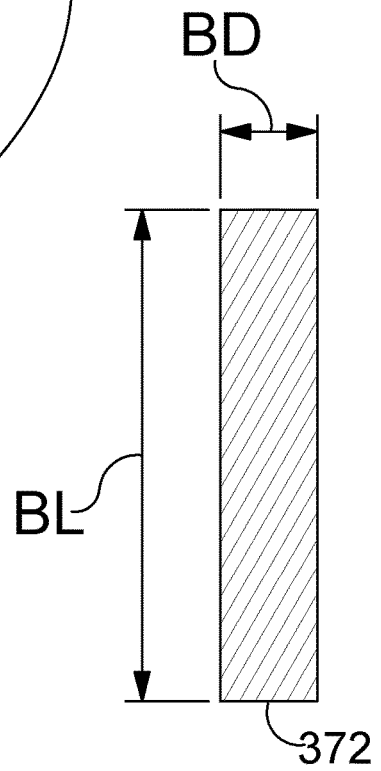
FIG. 11B is a cross-sectional view of a billet cut from a length of straightened metal wire.
Figure 12A:
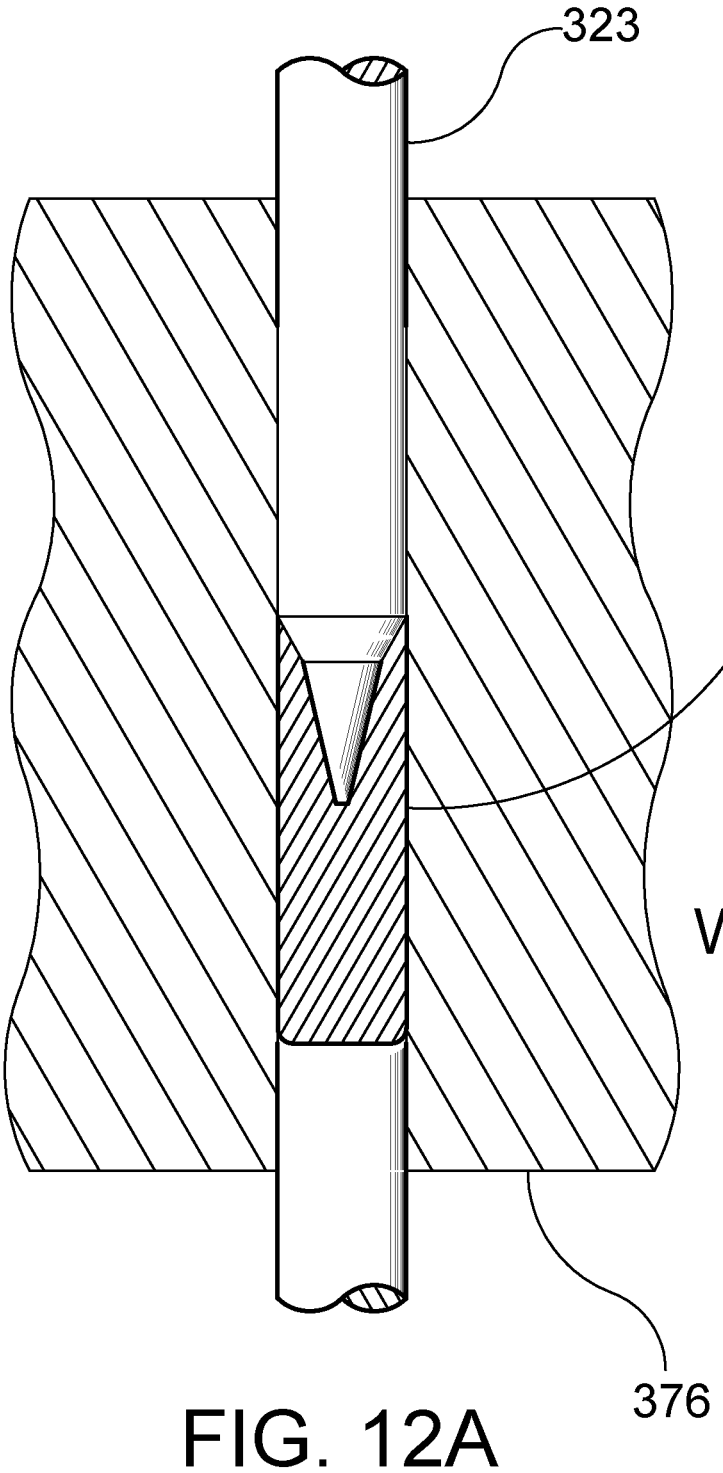
FIG. 12A is a partial cross-sectional view showing an assembly including a first die, a tool and a pin.
Figure 12B:
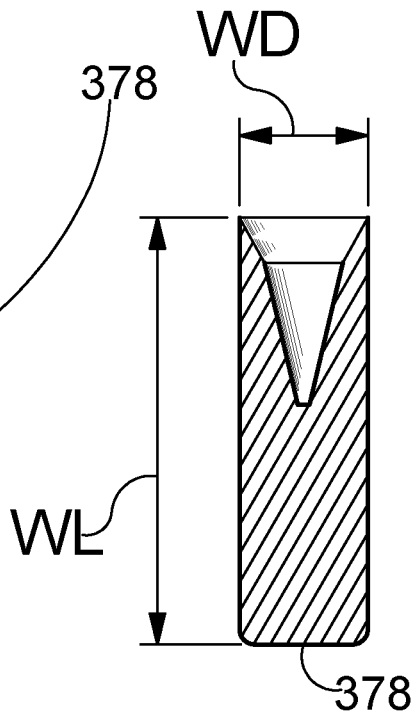
FIG. 12B is a cross-sectional view of a workpiece formed using a method in accordance with the detailed description.
Figure 13A:
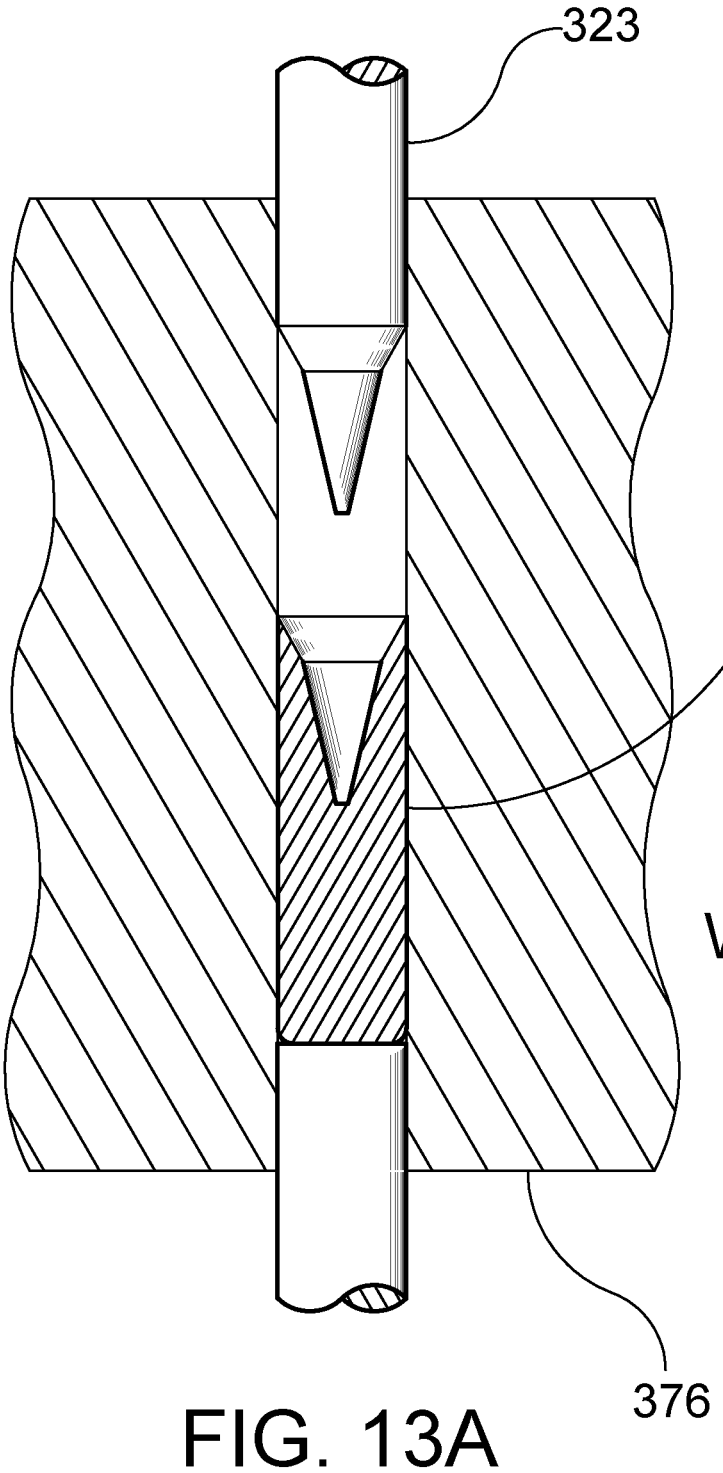
FIG. 13A is a partial cross-sectional view showing an assembly including a first die, a tool and a pin.
Figure 13B:
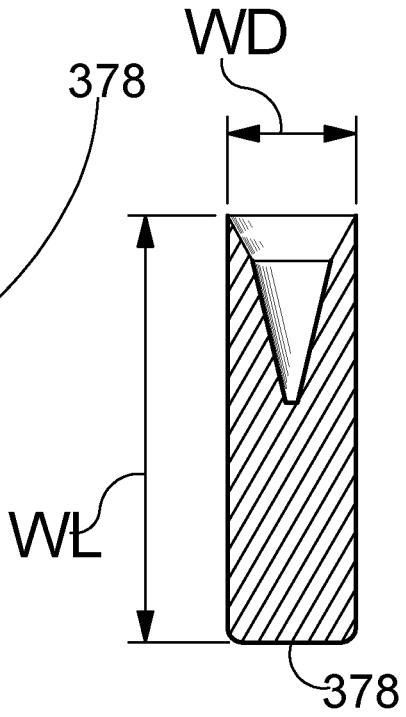
FIG. 13B is a cross-sectional view of a workpiece formed using a method in accordance with the detailed description.
Figure 14A:
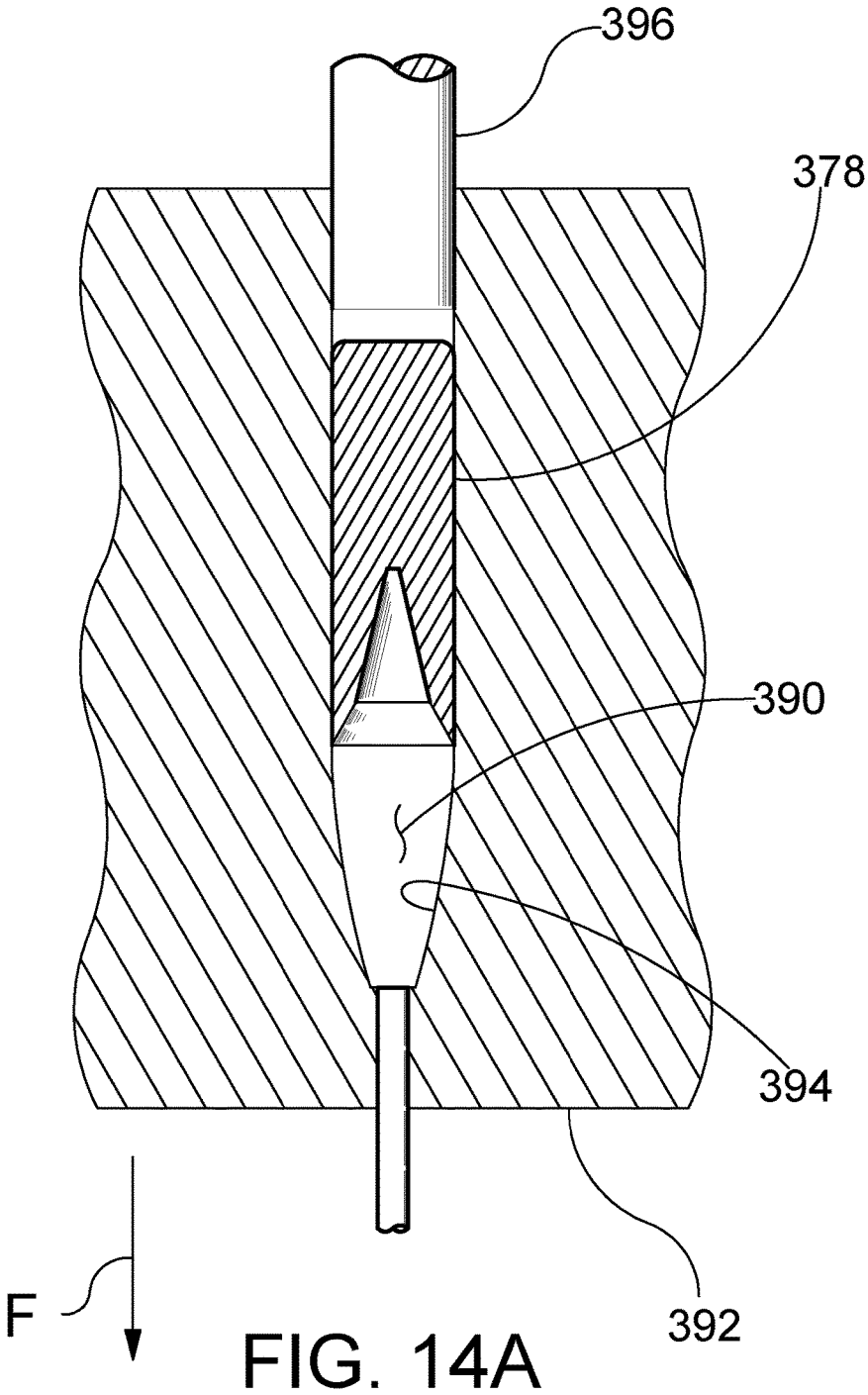
FIG. 14A is a partial cross-sectional view showing an assembly including a second die defining a die cavity and a workpiece disposed in the die cavity.
Figure 14B:
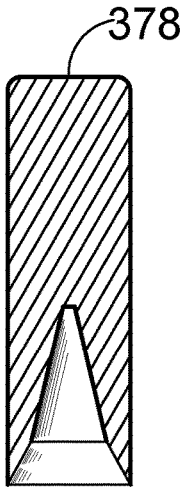
FIG. 14B is a cross-sectional view of a workpiece formed using a method in accordance with the detailed description.
Figure 15A:
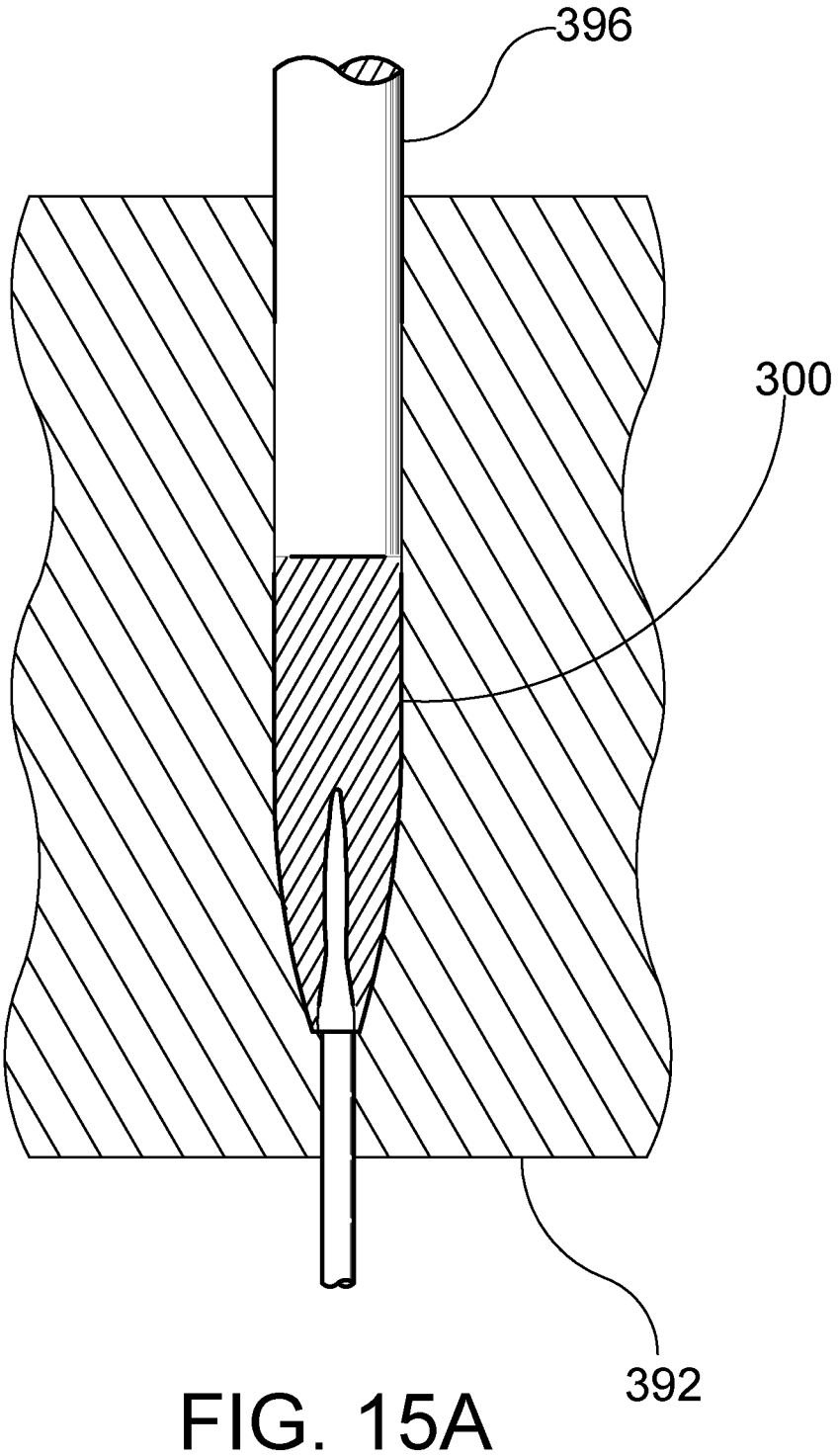
FIG. 15A is a partial cross-sectional view showing an assembly including a second die and a drive pin.
Figure 15B:
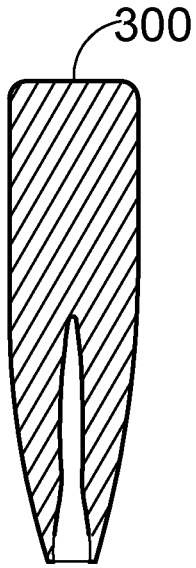
FIG. 15B is a cross-sectional view of a projectile body formed using a method in accordance with the detailed description.
Figure 16:
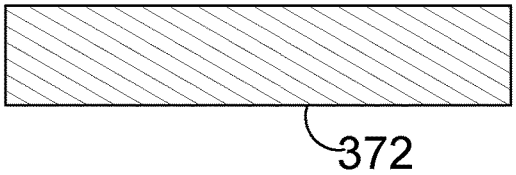
FIG. 16 depicts a flowchart diagram of a method of manufacturing a projectile, according to one or more embodiments.
Figure 16:
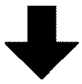
Figure 16:
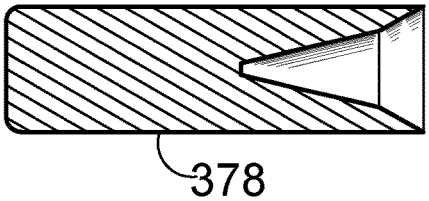
Figure 16:
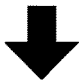
Figure 16:
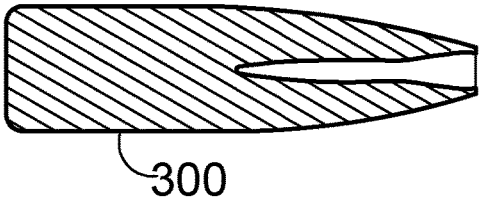
Figure 16:
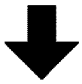
Figure 16:
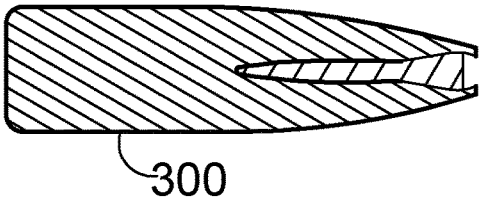
Figure 16:
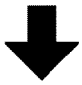
Figure 16:
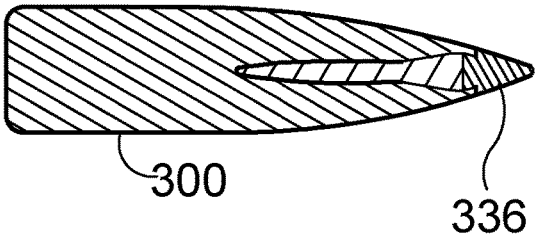

Referring to FIG. 9, a flowchart diagram of a method 250 is depicted, according to one or more embodiments. The method 250 includes, in operation 254 locating a projectile body at least partially within a tip mold. In certain embodiments, the projectile body is a projectile body as described herein. In operation 258, the method 250 may include injecting thermoplastic material into the tip mold. In operation 262, the method 250 includes cooling the thermoplastic material to solidify and form the polymer tip. And in operation 266, the method 250 may include ejecting the formed expanding projectile from the mold.

Referring to FIGS. 10A-16, a method of forming a projectile in accordance with one or more embodiments comprises arranging for a coil C of metal wire 370 to be shipped from a first geographic location to a second geographic location. In one or more embodiments, the metal wire 370 has a standard wire gauge such as a wire gauge listed in the American Wire Gauge (AWG) system. In one or more embodiments, the first geographic location and the second geographic location are separated by a distance of more than 500 miles. The method may further include feeding a length of the metal wire 370 through a plurality of rollers R to straighten the metal wire 370. The metal wire may be cut to form a billet 372 having a billet length BL and a billet diameter BD. The billet 372 may be placed in a lumen 374 defined by a first die 376. In one or more embodiments, the lumen 374 has a lumen diameter LD that is greater than the billet diameter BD and a lumen length LL that is greater than the billet length BL. A pin 398 is positioned in the lumen 374 defined by a first die 376 on a first side of the billet 372 and a tool 323 is positioned in the lumen 374 defined by the first die 376 on a second side of the billet 372 so that the billet 372 is disposed between the pin 398 and the tool 323. One of the tool 323 and the pin 398 is moved toward the other of the tool 323 and the pin 398 so that the billet 372 is squeezed between the tool 323 and the pin 398 thereby forming a workpiece 378 by deforming the billet 372. In one or more embodiments, the workpiece has workpiece diameter WD that is greater than the billet diameter BD and a workpiece length WL that is smaller than the billet length BL.

In one or more embodiments, the method also includes placing the workpiece 378 in a die cavity 390 defined by a second die 392. In one or more embodiments, the die cavity 390 has a tapered surface 394 and the tapered surface 394 has a taper radius that decreases as the tapered surface extends in a forward direction F. An end of a drive pin 396 is inserted into the die cavity 390. The drive pin 396 may be used to push the workpiece 378 against the tapered surface 394 so that a forward portion of the workpiece 378 is deformed to form a projectile body 300. The method may also include introducing a liquid elastomer into an interior cavity defined by the projectile body 300. In one or more embodiments, the liquid elastomer fills the interior cavity from a cavity end point to a fill point spaced forward of the cavity end point and the liquid elastomer has a forward facing elastomer surface at the fill point. The forward facing elastomer surface and the interior surface of the projectile body 300, forward of the forward facing elastomer surface, define an undercut interior cavity portion.

In one or more embodiments, the method includes obtaining a converging tip mold configured to form a polymer tip. The converging tip mold has an injection port extending to a mold cavity in one or more embodiments. In one or more embodiments, a forward portion of the projectile body is located within the converging tip mold, whereby a mold cavity is defined by at least the undercut interior cavity portion and a converging interior mold surface spaced forward of the annular forward edge. In one or more embodiments, the interior mold surface is in flush alignment with an exterior surface of the metal jacket. In one or more embodiments, the method includes injecting a melted polymer into the converging tip mold, thereby filling the undercut interior cavity portion and the converging tip mold with the melted polymer and allowing the melted polymer to cool to form the polymer tip. In one or more embodiments, the polymer tip has an exterior that is substantially flush with the exterior surface of the metal jacket. In one or more embodiments, the polymer tip has a main portion forward of the opening and a widening tip retention portion filling the undercut interior cavity portion. In one or more embodiments, the widening tip retention portion has a shape corresponding to the undercut interior cavity portion to retain the polymer tip in place.

The following United States patents are hereby incorporated by reference herein: U.S. Pat. Nos. 3,881,421, 4,044,685, 4,655,140, 4,685,397, 5,127,332, 5,259,320, 535,101, 6,070,532, and 8,186,277.

The following United States patents are hereby incorporated by reference herein: U.S. Pat. Nos. 1,080,974, 1,135,357, 1,493,614, 1,328,334, 1,967,416, 375,158, 4,108,074, 4,245,557, 5,454,325, 6,317,946, 6,526,893, 7,380,502, 8,161,885, 8,186,277, 8,413,587, and 8,393,273.

Some polymer tips consist of a tip retained by a long axial shank for insertion into the central pit or frontal cavity. These tips utilize friction between the axial shank and the material of the projectile for retention of the tip. In some bullets, an elastomeric filler is deposited in a liquid form in pistol bullet cavities forming an elastomeric plug that is flat and extends to the tip of the bullet. See US Pat. Pub. 2005/0126422, which is incorporated herein by reference. In some instances, an injection molded tips forms rounded shallow tips for rifle bullets. In such instances a shallow cavity is topped off with an injection molded polymer with the entirety of the polymer tip being in the shallow cavity or extending slightly above the cavity. See UK 1,038,702, incorporated herein by reference.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A method of manufacturing an insert-molded expanding projectile comprising:

obtaining a projectile body extending from a tail portion to a nose portion comprising an interior solid core, the projectile body tapered at the nose portion in a forward direction to an annular forward edge, the annular forward edge defining an opening to an interior surface, the projectile body including an interior cavity extending from the opening rearward to a cavity end point within the projectile body, the interior cavity defined by the interior surface and comprising an undercut interior cavity portion, the cavity diverging rearwardly toward the cavity end point;

obtaining a converging tip mold configured to form a polymer tip, the converging tip mold having an injection port extending to a mold cavity;

locating at least a forward portion of the projectile body within the converging tip mold, whereby the mold cavity is defined by the undercut interior cavity portion and a converging interior mold surface, the interior mold surface in alignment with an exterior surface of the projectile body;

injecting a melted polymer into the converging tip mold, thereby filling the interior cavity diverging rearwardly and the converging tip mold with the melted polymer; and allowing the melted polymer to cool to form the polymer tip, the polymer tip having an exterior in alignment with the exterior surface of the projectile body, the polymer tip comprising a main portion forward of the opening and a widening tip retention portion filling the undercut interior cavity portion, the widening tip retention portion comprising a shape corresponding to the undercut interior cavity portion to retain the polymer tip in place.

2. The method of claim 1, the step of allowing the melted polymer to cool further comprising bonding, via adhesion, the widening tip retention portion to the interior surface of the projectile body to retain the polymer tip in place.

3. The method of claim 1, the projectile body further comprising a core, and a metal jacket extending from the tail portion to the nose portion and surrounding the core to define the exterior surface of the projectile body.

4. The method of claim 3, wherein: the forward portion of the metal jacket includes a plurality of longitudinal skives spaced circumferentially about the metal jacket and extending in a rearward direction; and the step of injecting the melted polymer comprises molding the polymer tip into the plurality of longitudinal skives.

5. The method of claim 4, the plurality of skives being defined by a plurality of folded portions of the metal jacket which are cut away and folded inwardly towards a central axis of the projectile body.

6. The method of claim 1, the metal jacket comprising an interior surface defining, in part, the undercut interior cavity portion; and the step of allowing the melted polymer to cool further comprising bonding, via adhesion, the widening tip retention portion to the forward facing interior surface and to the interior surface of the metal jacket forward of the forward facing interior surface to retain the polymer tip in place.

7. The method of claim 1, further comprising:

before the step of obtaining the converging tip mold, introducing a liquid elastomer into the interior cavity, thereby filling the interior cavity from the cavity end point to a fill point spaced forward of the cavity end point, the liquid elastomer forming a forward facing surface at the fill point, the forward facing surface comprising the cavity end point.

8. The method of claim 1, the projectile body formed of a material comprising copper.

9. The method of claim 1, wherein the projectile body is unitary and does not comprise lead.

10. A method of manufacturing an insert-molded expanding projectile comprising:

obtaining a projectile body extending from a tail portion to a nose portion, the projectile body tapered at the nose portion in a forward direction to an annular forward edge, the annular forward edge defining an opening, the projectile body including an interior cavity extending from the opening rearward to a cavity end point within the projectile body;

introducing a liquid material into the interior cavity, thereby filling the interior cavity from the cavity end point to a fill point spaced forward of the cavity end point, the liquid material forming a forward facing surface at the fill point;

obtaining a converging tip mold configured to form a polymer tip, the converging tip mold comprising an injection port extending to a mold cavity, the mold cavity being defined by at least the interior cavity portion and a converging interior mold surface spaced forward of the annular forward edge;

locating at least a forward portion of the projectile body within the converging tip mold, the interior mold surface being in alignment with an exterior surface of the projectile body;

injecting a melted polymer into the converging tip mold, thereby filling the interior cavity portion and the converging tip mold with the melted polymer; and allowing the melted polymer to cool to form the polymer tip, the polymer tip comprising an exterior in alignment with the exterior surface of the projectile body, the polymer tip comprising a main portion forward of the opening and a tip retention portion filling the interior cavity portion, the widening tip retention portion comprising a shape corresponding to the interior cavity portion to retain the polymer tip in place.

11. The method of claim 10, the projectile body further comprising a metal jacket surrounding a core, the metal jacket tapered at the nose portion in a forward direction to the annular forward edge, the interior cavity defined by the forward facing surface and an interior surface of the metal jacket forward of the forward facing surface.

12. The method of claim 11, the step of introducing the liquid material further comprising the interior cavity portion being an undercut interior cavity portion defined by the forward facing surface and the interior surface of the metal jacket;

the step of injecting the melted polymer into the converging tip mold further comprising filling the undercut interior cavity portion and the converging tip mold with the melted polymer; and the step of allowing the melted polymer to cool further comprising a widening tip retention portion of the polymer tip filling the undercut interior cavity portion, the widening tip retention portion comprising a shape corresponding to the undercut interior cavity portion to retain the polymer tip in place.

13. The method of claim 10, wherein:

allowing the melted polymer to cool thereby bonds, via adhesion, the tip retention portion to the forward facing interior to retain the polymer tip in place.

14. The method of claim 10, wherein:

the step of introducing the liquid material occurs before locating at least the forward portion of the projectile body within the converging tip mold, and wherein the liquid material is a liquid elastomer.

15. The method of claim 10, further comprising:

allowing the liquid material to cool;

wherein allowing the liquid material to cool thereby forms the forward facing surface.

16. The method of claim 10, wherein:

a forward portion of the metal jacket includes a plurality of longitudinal skives spaced circumferentially about the metal jacket and extending in a rearward direction, from the annular forward edge, to a skive end point at the nose portion.

17. The method of claim 10, wherein the metal jacket and the interior solid core of the projectile body is a unitary metal structure.

18. The method of claim 10, wherein the interior solid core comprises lead and the metal jacket comprises copper.

19. A method of manufacturing a projectile comprising:

obtaining a projectile body including a metal jacket extending from a tail portion to a nose portion and surrounding a core, the metal jacket at the nose portion comprising an annular forward edge, the metal jacket and the nose portion defining the forward portion and comprising an annular ridge surrounding the forward portion, the annular forward edge defining an opening in the metal jacket to a forward facing interior surface of the core, the forward facing interior surface of the interior core being substantially aligned with the annular forward edge of the metal jacket; and obtaining a converging tip mold configured to form a polymer tip, the converging tip mold comprising an injection port extending to a mold cavity, the mold cavity comprising an interior mold surface;

locating at least a forward portion of the projectile body within the converging tip mold and with the interior mold surface in alignment with an exterior surface of the projectile body;

injecting a melted polymer into the converging tip mold, thereby filling the opening and the converging tip mold with the melted polymer, and thereby filling the annular ridge; and allowing the melted polymer to cool to form the polymer tip, the polymer tip comprising an exterior surface in alignment with the exterior surface of the metal jacket rear of the forward portion, the polymer tip comprising a main portion forward of the opening and a tip retention portion, wherein the tip retention portion contacts the forward facing interior surface and is disposed around an exterior of the projectile body at the forward portion, the tip retention portion comprising a shape corresponding to the interior cavity portion and the annular ridge to retain the polymer tip in place.

20. The method of claim 19, wherein the forward portion and the annular forward edge define an exterior undercut shape including undercut portions at the exterior of the metal jacket, the annular tip retention portion filling in the exterior undercut portion.

21. The method of claim 19, the forward facing interior surface of the interior core comprising a central indentation.

* * * * *